US007041423B2

(12) United States Patent
Kunugi et al.

(10) Patent No.: US 7,041,423 B2
(45) Date of Patent: May 9, 2006

(54) DEVELOPING METHOD AND IMAGE FORMING METHOD

(75) Inventors: Masanao Kunugi, Nagano (JP); Atsunori Kitazawa, Nagano (JP); Hiroshi Toyama, Nagano (JP)

(73) Assignee: Seiko Epson Corporation, Tokyo (JP)

( * ) Notice: Subject to any disclaimer, the term of this patent is extended or adjusted under 35 U.S.C. 154(b) by 146 days.

(21) Appl. No.: 10/670,798

(22) Filed: Sep. 26, 2003

(65) Prior Publication Data

US 2005/0095525 A1 May 5, 2005

(30) Foreign Application Priority Data

Sep. 27, 2002 (JP) ..... P. 2002-282807

(51) Int. Cl.
*G03G 15/08* (2006.01)

(52) U.S. Cl. ..... 430/120; 399/284

(58) Field of Classification Search ..... 430/110.1, 430/111.4, 120; 399/284
See application file for complete search history.

(56) References Cited

U.S. PATENT DOCUMENTS 5,283,618 A 2/1994 Hosoya et al.
5,683,846 A 11/1997 Ishihara et al.
6,566,028 B1 * 5/2003 Tazawa et al. ..... 430/137.11

FOREIGN PATENT DOCUMENTS

| | | | |
|---|---|---|---|
| EP | 0 520 799 | A2 | 12/1992 |
| EP | 0 710 894 | A1 | 5/1996 |
| JP | 5-2287 | A | 1/1993 |
| JP | 8-129268 | A | 5/1996 |

* cited by examiner

*Primary Examiner*—John L Goodrow
(74) *Attorney, Agent, or Firm*—Sughrue Mion, PLLC

(57) ABSTRACT

A developing method, including the steps of: carrying one-component non-magnetic toner on a developer carrier; pressing the one-component non-magnetic toner by a regulating member so as to regulate a transporting quantity of the one-component non-magnetic toner so that the one-component non-magnetic toner is charged; forming an electrostatic latent image on an image carrier; providing the one-component non-magnetic toner to the electrostatic latent image so as to convert the electrostatic latent image into a visible toner image; and controlling the one-component non-magnetic toner so that the one-component non-magnetic toner pressed by the regulating member satisfies the following relationship: $B/A \leqq 1$, where A represents a width [μm] of a particle size distribution of the one-component non-magnetic toner; and B represents a width [fC] of a charge quantity distribution of the one-component non-magnetic toner.

11 Claims, 9 Drawing Sheets

DEVELOPING METHOD AND IMAGE FORMING METHOD

BACKGROUND OF THE INVENTION

The present invention relates to a developing method and an image forming method, and more particularly to a developing method and an image forming method performed to form an image in an electrostatic latent image developing mode employed in a printer, a copying machine, etc.

A quantity of charge of toner used to form an image in an electrostatic latent image developing mode is known to have significant influences on image formation. More concretely, in the electrophotographic process, toner adheres to a photosensitive body due to the charging characteristic of individual toner particles, and is then transferred onto a transfer body, whereby an image is formed. Hence, it is thought that most of the problems, such as fogging, scattering, transfer dust, deterioration over time, and environmental deterioration, which need to be addressed in the electrophotographic process, are attributed to wrong toner incapable of controlling a quantity of charge. A crucial problem in the related process is therefore to charge the toner as homogeneously as possible.

In regard to an image forming method performed by controlling the charging characteristic of toner, a cleaner-less image forming method has been proposed as described in JP-A-5-2287, page 3, in which the intrinsic electric resistance value, R, of developing toner to be used satisfies $R \geqq 1\times10^{13}$ Ω·cm, and a quantity of charge, $q_t$, of the developing toner is set to $0.5[mC/kg] \leqq |q_t| \leqq 40[mC/kg]$. This image forming method, however, merely defines a quantity of charge of the developing toner in relation with the intrinsic electric resistance value, and fails to suggest a relation between a charge quantity distribution and a particle size distribution of toner as an aggregation of individual particles.

Also, second example of a developing method has been proposed (see JP-A-8-129268, pages 2 to 3), in which, given Y as an index indicating voltage dependency of a developer, containing magnetic carriers and toner, found from a resistance value, $R_{500}$ [Ω·cm], at a field intensity of 500 V/cm and a resistance value, $R_{2500}$ [Ω·cm], at a field intensity of 2500 V/cm, and X as a particle count ratio [%] indicating a percentage of non-changed toner of the total toner in a range, Q/D<0.2, within a charge quantity distribution of the toner defined by a quantity of charge, Q [femt.C], and a particle size, D [μm], of the toner, then an electrophotographic image developer set to satisfy Y>(3X/400)+1 is used. This method, however, uses two-component toner containing magnetic carriers and toner; moreover, it merely defines a particle count ratio of non-charged toner, which causes smearing of an image, in relation with resistance values at certain field intensities, and no consideration is given to a relation between a charge quantity distribution and a particle size distribution of toner as an aggregation of individual particles.

Currently, a quantity of charge of toner is understood as a mere total quantity of charge in toner with reference to a mass of the toner, and it is therefore impossible to control a quantity of charge of individual toner particles. As a result, the presence of wrong toner incapable of controlling a quantity of charge is allowed, which not only gives rise to fogging or the like, but also deteriorates transfer efficiency and thereby impairs an image quality. Deterioration of transfer efficiency not only increases waste toner remaining on the photosensitive body after the completion of transfer, but also prevents omission or simplification of a cleaner mechanism used to clean the waste toner (adaptation of a cleaner-less process). As described, the developing methods proposed to date have a limit in the improvement of an image quality in image formation, a reduction of an apparatus in size, etc.

SUMMARY OF THE INVENTION

It is therefore an object of the invention to provide a developing method and an image forming method which can lessen problems, such as fogging, scattering, and transfer dust, caused by inhomogeneity in toner, while enabling a cleaner-less process and a reduction of waste toner by improving transfer efficiency.

In order to achieve the above object, according to the present invention, there is provided a developing method, comprising the steps of:

carrying one-component non-magnetic toner on a developer carrier;

pressing the one-component non-magnetic toner by a regulating member so as to regulate a transporting quantity of the one-component non-magnetic toner so that the one-component non-magnetic toner is charged;

forming an electrostatic latent image on an image carrier;

providing the one-component non-magnetic toner to the electrostatic latent image so as to convert the electrostatic latent image into a visible toner image; and controlling the one-component non-magnetic toner so that the one-component non-magnetic toner pressed by the regulating member satisfies the following relationship:

$$B/A \leqq 1$$

where A represents a width [μm] of a particle size distribution of the one-component non-magnetic toner; and B represents a width [fC] of a charge quantity distribution of the one-component non-magnetic toner.

In the developing method of negatively charging one-component non-magnetic toner through press-regulation by the regulating member, it is important to understand a charge quantity distribution of a given aggregation of toner in relation with a particle size distribution of this particular aggregation of toner. Also, as will be described in Examples below, it is revealed that when B/A is controlled to be 1 or less in a relation between the charge quantity distribution and the particle size distribution, the toner performance is in a satisfactory state and problems, such as fogging, scattering, transfer dust, deterioration over time, and environmental deterioration, can be eliminated. The reason why is assumed as follows: when the surface of a single toner particle is concerned, toner satisfying the above-specified condition has no reverse charge in the charge distribution on the surface (for example, a positively charged portion on the negatively charged toner surface), and is therefore charged homogenously in an ideal state. Hence, by performing development under the condition such that satisfies the above-specified condition, wrong toner can be reduced to the least possible degree.

Preferably, the control step is performed to satisfy the following relationship;

$$a>b$$

where a represents a particle size [μm] in a particle size segment having a largest particle count in the particle size distribution of the one-component non-magnetic toner; and b represents a particle size [μm] in a particle size segment having a largest particle count in the particle size distribution in every charge quantity segment.

In the above method, by effecting the control to satisfy the relation, a>b, in addition to the control to maintain B/A to 1 or less, it is possible to perform development while the toner performance is upgraded further.

Preferably, the control step is performed to satisfy a relation that a ratio of toner of reverse polarity in the charge quantity distribution of the one-component non-magnetic toner is less than 5%.

In the above method, by controlling a ratio of toner of reverse polarity (for example, positively charged toner in negatively charged toner) to be less than 5%, the occurrence of fogging can be suppressed further, which in turn makes it possible to perform development while the toner performance is upgraded further.

Here, it is preferable that, the control step is performed to satisfy a relation that a toner particle count in a charge quantity segment having a largest particle count in the charge quantity distribution in every particle size segment is 10% or higher of total toner.

In the above method, by controlling the toner particle count in the charge quantity segment having the largest particle count to account for 10% or higher of the total toner, it is possible to perform development in an optimal toner performance state.

Preferably, at least one of kinds, resin composition and shape of the toner base particles of the one-component non-magnetic toner is determined in the control step.

Preferably, at least one of kinds and quantities of the extraneous additives added to the one-component non-magnetic toner is determined in the control step.

Preferably, a surface material of the developer carrier is determined in the control step.

Preferably, a regulating condition of the regulating member is determined in the control step.

Preferably, the transporting quantity of the one-component non-magnetic toner is determined in the control step.

According to the present invention, there is also provided an image forming method, comprising the steps of:

carrying a one-component non-magnetic toner on a developer carrier;

pressing the one-component non-magnetic toner by a regulating member so as to regulate a thickness thereof so that the one-component non-magnetic toner is charged;

forming an electrostatic latent image on an image carrier;

providing the one-component non-magnetic toner to the electrostatic latent image so as to convert the electrostatic latent image into a visible toner image;

controlling the one-component non-magnetic toner so that the one-component non-magnetic toner pressed by the regulating member satisfies the following relationship:

$$B/A \leqq 1$$

where A represents a width [μm] of a particle size distribution of the one-component non-magnetic toner; and B represents a width [fC] of a charge quantity distribution of the one-component non-magnetic toner; and transferring the visible image so as to form an image.

In the above method, because image formation can be performed in a state where wrong toner is reduced to the least possible degree by the developing method according to any of the first through fourth aspects, not only can problems, such as fogging, scattering, and transfer dust, be avoided, but also transfer efficiency can be improved, which in turn makes it possible to reduce waste toner.

Preferably, wherein the method uses an image forming apparatus having no cleaner mechanism that cleans waste toner remaining on the image carrier after the transferring step. In the above method, wrong toner is suppressed to the least possible degree in the image forming method of the invention, and transferring is performed at high efficiency. Hence, it is possible to omit a cleaning step of cleaning waste toner remaining on the image carrier. As a result, image formation is also possible in a cleaner-less image forming apparatus that omits a cleaner mechanism, and a reduction in size and simplification of an image forming apparatus can be thus achieved.

BRIEF DESCRIPTION OF THE DRAWINGS

The above objects and advantages of the present invention will become more apparent by describing in detail preferred exemplary embodiments thereof with reference to the accompanying drawings, wherein.

DETAILED DESCRIPTION OF THE PREFERRED EMBODIMENTS

Figure 1:
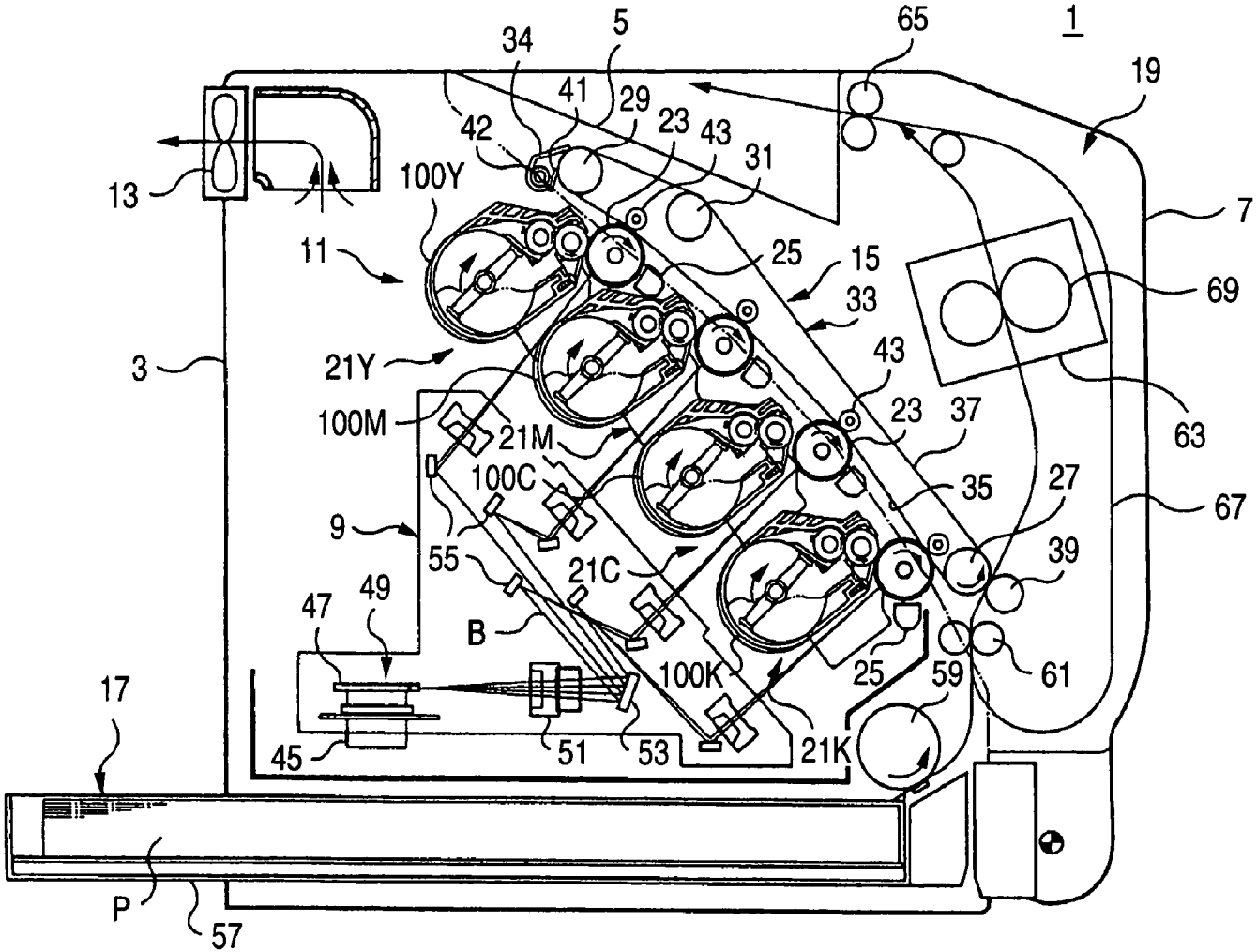
FIG. 1 is a view showing an example of an image forming apparatus usable in a developing method of the invention.

A developing method of the invention is applied to a process of converting an electrostatic latent image formed on an image carrier into a visible toner image by providing the electrostatic latent image with one-component non-magnetic toner carried on a developer carrier after the one-component non-magnetic toner is charged through press-regulation by a regulating member, and when a rate of individual toner particles in the one-component non-magnetic toner having been press-regulated by the regulating member is measured through the laser Doppler method in a vibration field within an acoustic relaxation cell and a particle size as well as a quantity of charge of individual toner particles are calculated based on the measurement result, the developing method is performed by controlling B/A to be 1 or less, where A is a width [μm] of a particle size distribution of the one-component non-magnetic toner and B is a width [fC] of a charge quantity distribution of the one-component non-magnetic toner.

Toner used in the developing method of the invention is one-component non-magnetic toner, and any known kind is available. To be more specific, as will be described below, kinds and quantities of blending of binder resin, colorants, additives, etc. used in one-component non-magnetic toner, the shape of base particles, a particle size, etc. can be designed by selecting known toner and toner materials of various kinds as needed.

A particle size and a quantity of charge of the one-component non-magnetic toner are measured in a vibration field within an acoustic relaxation cell through the laser Doppler method. The laser Doppler method is a known method of measuring a rate of a moving body using a phenomenon (Doppler effect) that when a laser beam is emitted to a moving body, the number of vibration of reflected and thus returning light varies in proportion to a rate of the moving body. In the invention, an aerodynamic size (a diameter of a sphere of a unit density having the same sedimentation rate as that of particles) and a quantity of charge of particles are found by measuring, through the laser Doppler method, a rate of particles or a phase-delay angle of motions of particles with respect to motions of a gas in the acoustic field. The measurement of a particle size and a quantity of charge through the laser Doppler method can be achieved with the use of a commercially available measuring device. An example of a preferred measuring device may be E-SPART Analyzer®, model EST-3 type (manufactured by Hosokawa Micron Ltd). In the measurement with the use of E-SPART Analyzer®, toner particles used as a sample are dropped in a space between two electrodes having opposite polarities. Charged toner particles move toward the electrode by the action of the electric field induced by the electrodes, and when electrodes are acoustically vibrated in this instance, particles are attracted to the electrode while being vibrated as well. A particle size and a quantity of charge are calculated by measuring the movement to the electrode and the vibration simultaneously through the laser Doppler method.

In other words, toner particles flowing in through an inlet of the measuring device are subjected to aerial vibration by sound, and thereby vibrate while causing a phase delay due to inertia of the particles. Because a phase delay is larger for larger particles, a particle size can be measured from the phase delay. Also, a quantity of charge of a particle can be calculated from a moving rate to the electrode and the particle size.

When toner particles are measured by E-SPART Analyzer®, the result may possibly vary with the measuring conditions, manipulations, etc., and for this reason, it is preferable to perform measurement by fixing the conditions and manipulations as will be described in Examples below.

In the developing method of the invention, given A as a width [μm] of a particle size distribution of one-component non-magnetic toner measured through the measuring method described above and B as a width [fC] of a charge quantity distribution of the one-component non-magnetic toner, then B/A is controlled so as to be 1 or less.

In other words, the particle size distribution width A is controlled to be equal to or larger than the charge quantity distribution width B. When the condition, $B/A \leqq 1$, is satisfied, it is assumed that a homogeneous charging state is achieved on the surface of individual toner particles. Hence, compared with the related method in which a quantity of charge [(a total quantity of charge/mass of an aggregation of toner)] is controlled for an aggregation of toner particles, more accurate control can be achieved, and problems, such as fogging, scattering, and transfer dust, can be therefore eliminated.

In the invention, "particle size distribution" and "charge quantity distribution" are evaluated in data of particle size segments and charge quantity segments having toner particles as many as or more than a predetermined number of particles as a ratio with respect to a total particle count in the one-component non-magnetic toner. This is because not all of a large number of toner particles can be controlled perfectly; moreover, because uncontrollable toner particles are inevitably included in an aggregation, it is adequate to understand the particle size distribution and the charge quantity distribution without concerning the charging characteristic of such uncontrollable toner particles. Hence, in the invention, "particle size distribution" and "charge quantity distribution" are determined for segments having a particle count that accounts for 1% or higher of the total toner particle count within particle size-to-charge quantity segments (see Table 1 and the like below) defined by a particle size in 0.5-μm steps and a charge quantity in 0.5-fC steps.

In addition to the condition, $B/A \leqq 1$, it is preferable to effect control to satisfy a relation, $a>b$, where a is a particle size [μm] in the particle size segment having the largest particle count in the particle size distribution of the one-component non-magnetic toner, and b is a particle size [μm] in the particle size segment having the largest particle count in the particle size distribution in every charge quantity segment. When the condition, $a>b$, is also satisfied in addition to the condition, $B/A \leqq 1$, the toner performance is further elevated. Herein, the particle size segments and the charge quantity segments are, as with the foregoing description, based on particle size-to-charge quantity segments (see Table 1 and the like below) defined by a particle size in 0.5-μm steps and a charge quantity in 0.5-fC steps.

Further, it is more preferable to control a ratio of toner of reverse polarity in the charge quantity distribution of the measured one-component non-magnetic toner (that is, after being press-regulated by the regulating member) to be less than 5%. By controlling a ratio of the toner of reverse polarity to be less than 5%, it is possible to reduce waste toner to the least possible degree, which makes it easier to achieve a cleaner-less image forming apparatus.

Furthermore, it is preferable to perform development while controlling a toner particle count in the charge quantity segment having the largest particle count in the charge quantity distribution in every particle size segment to account for 10% or higher of the total toner. This enables development under an optimal toner performance state.

In the method of the invention, the charge quantity distribution and the particle size distribution of the one-component non-magnetic toner having been press-regulated by the regulating member can be controlled to satisfy the above-specified relations by adjusting factors generally concerned in a design of toner and a design of a developing device. For example, the toner design factors include ① the kinds, resin composition, shape of toner base particles; ② kinds and quantities of extraneous additives, etc. The developing device design factors include: ③ a surface material and a surface hardness of the developing roller used as a developer carrier; ④ a material and regulating conditions (pressing force, etc.) of a regulating blade used as the regulating member, a quantity of toner being transported when the regulating bladed passes by, etc. It should be noted, however, that it is generally difficult to univocally determine the relation, $B/A \leqq 1$, with only one of the factors specified in ① through ④ by way of example. In other words, when one factor is specified, the conditions vary in relation with another factor, and the relation, $B/A \leqq 1$, may not be achieved. Hence, it is preferable to determine the settings of these factors separately through experiments, and the conditions described in Examples below will serve as a reference.

In the following, typical factors to control the particle size distribution and the charge quantity distribution of one-component non-magnetic toner will be described by way of example. In the method of the invention, the particle size distribution and the charge quantity distribution can be controlled by selecting factors described below. It should be appreciated, however, that these factors are not for the purpose of limitation, and control is also possible by adjusting other factors.

<Toner Base Particles>

Kinds of binder resin in the toner base particles, in particular, polar functional groups in the resin, have influences on the charging characteristic of the toner base particles. Examples of the binder resin include, polyester resin, styrene-acrylic copolymer, polystyrene, poly-α-methylstyrene, chloropolystyrene, styrene-chlorostyrene copolymer, styrene-propylene copolymer, styrene-butadiene copolymer, styrene-vinyl chloride copolymer, styrene-vinyl acetate copolymer, epoxy resin, urethane modified epoxy resin, silicone modified epoxy resin, vinyl chloride resin, rosin modified maleate resin, phenyl resin, polyethylene, polypropylene, ionomer resin, silicone resin, ketone resin, ethylene-ethylacrylate copolymer, xylene resin, polyvinyl butyral resin, terpene resin, phenol resin, urethane/urea resin, aliphatic or alicyclic hydrocarbon resin, etc. In the method of the invention, one kind or two or more kinds of known binder resin represented by the foregoing can be selectively used.

The shape of the toner base particles is preferably close to a spherical form having a uniform surface structure, and it is preferable that individual base particles vary little in size and shape. A circularity (ensphering coefficient) of the toner base particles is preferably 0.91 or higher, and it is preferable to adjust a circularity to be 0.95 or higher in order to improve transfer efficiency while preventing generation of toner of reverse polarity.

The toner base particles can be manufactured through the pulverizing method or the polymerization method. Pulverizing method toner is manufactured by: mixing binder resin with a pigment, a releasing agent, and a charge control agent homogeneously in a Henschel mixer; melting and kneading the resulting mixture in a double-shaft extruder; cooling the resulting mixture followed by a crushing and pulverizing process; subjecting the resulting particles to particle sizing; and adding a fluidity conditioner. Ensphering treatment may be performed to adjust a circularity of the pulverizing method toner. When an apparatus capable of pulverizing substances into a relatively circular spherical form, for example, Turbomill (manufactured by Kawasaki Heavy Industrial Ltd.) known as a mechanical pulverizing machine, is used in the pulverizing process, a circularity as high as 0.93 can be achieved. When the pulverized toner is further treated in a commercially available hot air ensphering apparatus, SURFUSING System SFS-3 type (manufactured by Nippon Pneumatic Mfg. Co., Ltd.), a circularity of 1.00 can be achieved.

A method of manufacturing polymerization method toner includes the suspension polymerization method, the emulsification polymerization method, etc. According to the suspension polymerization method, a monomer composition, in which is dissolved or dispersed a mixture of a polymeric monomer added with a coloring pigment and a releasing agent as needed, as well as a dye, a polymerization initiator, a crosslinking agent, a charge control agent, and other additives, is added to a liquid phase containing a suspension stabilizer (water-soluble polymer, hard water-soluble inorganic substance) with stirring, and the resulting mixture is allowed to undergo granulation followed by polymerization, whereby colored polymerized toner particles of a desired particle size are obtained.

In regard to adjustment of a circularity of the polymerization method toner, a circularity can be changed freely by controlling a temperature and a time during the aggregation process of secondary particles in the emulsification polymerization method, and a circularity can be changed in a range from 0.94 to 1.00. On the other hand, in the suspension polymerization method, because toner particles of spherical form can be obtained, a circularity is in a range from 0.98 to 1.00. A circularity may be adjusted by subjecting the toner particles to deformation with heating at or above a glass transition temperature of toner, Tg, and a circularity can be adjusted freely in a range from 0.94 to 0.98.

In either of the pulverizing method toner and the polymerization method toner, the glass transition temperature can be set in a range from 50 to 100° C., and more preferably, in a range from 55 to 90° C., and a flow softening temperature can be set in a range from 70 to 140° C., and more preferably in a range from 75 to 130° C.

Besides the binder resin, known colorants or charge control agents can be added to the toner base particles. The charge control agents are not especially limited as long as particles are positively or negatively charged through triboelectric charging, and organic or inorganic charge control agents of various kinds can be used.

Examples of a positive charge control agent include, Nigrosine Base EX, Quaternary Ammonium Salt P-51, Nigrosine Bontoron N-01 (products all available from Orient Chemical Industries, Ltd.), Sudan Chief Schwalts BB (Solvent Black 3: C.I. No. 26150), Fet Schwalts HBN (C.I. No. 26150), Brilliant Split Schwalts TN (product available from Farben Fabricken Bayer K.K.), Zapanschwarz X (product available from Farberk Hoechst Co., Ltd.), alkoxylated amine, alkylamide, molybdic chelataing pigments, etc.

Also, examples of a negative charge control agent include, Oil Black (C.I. No. 26150), Oil Black BY (product available from Orient Chemical Industries, Ltd.), Bontron S-22 (product available from Orient Chemical Industries, Ltd.), Salicylic Acid Metal Chelate E-81 (product available from Orient Chemical Industries, Ltd.), thioindigo pigments, sulfonylamine derivatives of copper phthalocyanine, Spiron Black TRH (product available from Hodogaya Chemical Industries, Ltd.), Bontron S-34 (product available from Orient Chemical Industries, Ltd.), Nigrosine S0 (product available from Orient Chemical Industries, Ltd.), Ceres Schwalts (R)G (product available from Farben Fabricken Bayer K.K.), Chromogene Schwalts ET00 (C.I. No. 14645), Azo Oil Black (R) (product available from National Aniline Co., Ltd.), etc. These charge control agents can be used either solely or in combination of two or more kinds. It should be noted, however, that a quantity of the charge control agent(s) to be added to the binder resin is adjusted to 0.001 to 5 parts by weight (preferably, in a range from 0.001 to 3 parts by weight) on the basis of 100 ( parts by weight of the binder resin.

<Extraneous Additives>

Extraneous additives are an important factor in controlling the charging characteristic of toner. Extraneous additives may be organic fine powder or inorganic fine powder. Examples of organic fine powder include, fluorine resin powder (that is, vinylidene fluoride fine powder, polytetrafluoro ethylene fine powder, or the like), acrylic resin fine powder, metallic salts of fatty acid (that is, zinc stearate, calcium stearate, lead stearate, or the like), etc. Examples of inorganic fine powder include, metal oxides (that is, iron oxide, aluminum oxide, titanium oxide, zinc oxide, or the like), fine powder of silica (that is, wet process silica, dry process silica, or the like), surface-treated silica, that is, silica of the foregoing kinds applied with surface treatment with the use of a silane coupling agent, a titanium coupling agent, silicon oil, or the like. One kind or a mixture of two or more kinds of the foregoing extraneous additives can be used.

<Developing Roller>

The developing roller can be a roller including a metal pipe with a diameter of approximately 16 to 24 mm, and plating or blast treatment is applied to the surface thereof, or alternatively a conductive elastic layer, made of NBR, SBR, EPDM, urethane rubber, silicon rubber or the like and having a volume resistance value of $10^4$ to $10^8$ Ω·cm and a hardness (ASKER A) of 40 to 70°, is formed on the peripheral surface of the central axis. It is arranged in such a manner that a developing bias voltage is applied to the developing roller through the shaft or the central axis of the pipe. A quantity of charge of toner particles can be adjusted by selecting a material and a treatment method of the developing roller, a volume resistance value and a hardness of the elastic layer, etc.

<Regulating Blade, Regulating Conditions, etc.>

The regulating blade includes, for example, SUS, phosphor bronze, a rubber plate or a metal thin plate, and a rubber chip laminated thereon. It is preferable to set a work function on the surface that comes in contact with toner to 4.8 to 5.4 eV, and it is preferable to set a smaller work function than that on the surface of toner.

A pressing force as one of the regulating conditions may vary with other conditions; however, it is preferable to set a pressing force sufficient to perform thin-layer regulation. To be more specific, by effecting thin-layer regulation that regulates toner at a pressing force such that allows the toner to form a single or nearly a single layer on the surface of the developing roller under the regulated state, individual particles of the one-component non-magnetic toner can be charged homogenously, which makes it easier to control a quantity of charge. Hence, it is preferable to press the regulating blade against the developing roller used as a developer carrier by a pushing member, such as a spring, or alternatively, through the use of a repulsive force, induced on its own as being an elastic body, at a linear load of 25 to 50 gf/cm.

A quantity of toner being transported when the regulating blade passes by varies with the other conditions; however, it is preferably set to 0.2 mg/cm$^2$ to 0.4 mg/cm$^2$ approximately. It is preferable to select a quantity of toner being transported depending on a particle size of the toner particles. For example, it is preferable to set a quantity of toner being transportation to approximately 0.25 mg/cm$^2$ for a toner particle size of 5 μm and approximately 0.35 mg/cm$^2$ for a toner particle size of 7 μm.

As described, control can be effect to satisfy the condition, $B/A \leqq 1$, by adjusting various factors. Also, the conditions, $a>b$, toner of reverse polarity accounts for less than 5%, and the toner particle count in the charge quantity segment having the largest particle count accounts for 10% or higher of the total toner, can be satisfied by adjusting the various factors in the same manner as described above.

Hereinafter, a developing method, a developing device usable in an image forming method, and an image forming apparatus of the invention will be explained with reference to the drawings. The developing method of the invention can be implemented in either a contact developing system or a non-contact developing system. Firstly, a developing device and an image forming apparatus adopting the non-contact developing system will be explained.

FIG. 1 is a cross section schematically showing an overall arrangement of an image forming apparatus 1 of a tandem type. The image forming apparatus 1 includes a housing 3, a paper discharge tray 5 formed on the upper portion of the housing 3, and an openable/closable door 7 provided to the front of the housing 3. An exposure unit 9, an image forming unit 11, an air-blow fan 13, a transfer belt unit 15, and a paper feed unit 17 are provided inside the housing 3, and a sheet transportation unit 19 is provided inside the door 7. The image forming apparatus 1 is a so-called cleaner-less image forming apparatus that omits a cleaner mechanism used to remove waste toner (non-transferred toner) on photosensitive drums 23.

The image forming unit 11 includes four image forming stations 21 into which four developing devices containing different colors of toner can be set, respectively. The four image forming stations 21 are provided for the developing devices for yellow, magenta, cyan, and black, respectively, and are distinguished in the drawing by numeral references 21Y, 21M, 21C, and 21K. Each of the image forming stations 21Y, 21M, 21C, and 21K is provided with a photosensitive drum 23 used as an image carrier, a corona charging unit 25 placed in the vicinity of the photosensitive drum 23, and a developing device 100 of the invention.

The transfer belt unit 15 includes a driving roller 27 rotated by an unillustrated driving source, a driven roller 29 provided diagonally above the driving roller 27, a tension roller 31, an intermediate transfer belt 33 pulled across the foregoing rollers to be circulated in a counterclockwise direction of FIG. 1, and a cleaning unit 34 that abuts on the surface of the intermediate transfer belt 33.

Each photosensitive drum 23 press-contacts the belt surface 35 along an arch-shaped line, and is rotated in a direction indicated by an arrow of FIG. 1. A tensile force of the intermediate transfer belt 33, a curvature of the arch, etc. can be controlled by adjusting the position of the tension roller 31.

The driving roller 27 serves also as a back-up roller of a secondary transfer roller 39. In addition, a rubber layer having, for example, a thickness of approximately 3 mm and a volume resistivity of $10^5$ Ω·cm or less is formed on the peripheral surface of the driving roller 27, and an electric conduction path for a secondary transfer bias to be supplied through the secondary transfer roller 39 is defined by grounding the driving roller 27 through a metal shaft. The diameter of the driving roller 27 is smaller than the diameters of the driven roller 29 and the tension roller 31, and this arrangement makes it easier for a recoding sheet to be separated by its own elastic force after the completion of the secondary transfer. The driven roller 29 functions also as a back-up roller of the cleaning unit 34.

The cleaning unit 34 is provided on the belt surface 35 side facing downward in the transportation direction, and includes a cleaning blade 41 that removes toner remaining on the surface of the intermediate transfer belt 33 after the completion of the secondary transfer, and a toner transportation path 42 through which collected toner is transported. The cleaning blade 41 abuts on where the intermediate transfer belt 33 is wound around the driven roller 29. Primary transfer members 43 abut on the back surface of the intermediate transfer belt 33 at the positions opposing the photosensitive drums 23 in the respective image forming stations 21Y, 21M, 21C, and 21K, and a transfer bias is applied to each primary transfer member 43.

The exposure unit 9 is provided in a space diagonally below the image forming unit 11, and the air-blow fan 13 is provided diagonally above the exposure unit 9. The paper feed unit 17 is provided below the exposure unit 9. A scanner unit 49 comprising a polygonal mirror motor 45 and a polygonal mirror 47 is installed in a perpendicular direction at the bottom portion of the exposure unit 9. A single f-θ lens 51 and a reflection mirror 53 are provided in an optical path B, and a plurality of return mirrors 55 are provided above the reflection mirror 53, so that non-parallel scanning optical paths for respective colors are returned to the corresponding photosensitive drums 23.

In the exposure unit 9, image signals corresponding to respective colors are emitted from the polygonal mirror 47 in the form of laser beams modulated based on a common data clock frequency, irradiated to the photosensitive drums 23 in the respective image forming stations 21Y, 21M, 21C, and 21K through the f-θ lens 51, the reflection mirror 53, and the return mirrors 55, whereby latent images are formed.

The air-blow fan 13 functions as a cooling unit and this type introduces air in a direction indicated by arrows of FIG. 1 and thereby functions to release heat from the exposure unit 9 and other heat-generating portions.

The paper feed unit 17 includes a paper feed cassette 57 in which recoding media P are piled up, and a pick-up roller 59 that feeds the recording media P one by one from the paper feed cassette 57. The paper transportation unit 19 includes a pair of gate rollers 61 that determines paper feed timing of a recording medium P to the secondary transfer portion, the secondary transfer roller 39 press-adhered to the driving roller 27 and the intermediate transfer belt 33, a fusing unit 63, a pair of paper discharge rollers 65, and a double-side printing transportation path 67.

The fusing unit 63 includes a pair of rotatable fusing roller 69 at least one of which enclosing a heat-generating body, such as a halogen heater, and a pressing unit for pressing a secondary image secondary transferred onto a sheet member against a recording medium P by pushing and pressing at least one of the pair of the fusing rollers 69 against the other. The secondary image secondary transferred onto the recording medium P is fused onto the recording medium P at a predetermined temperature in a nip portion formed by the pair of fusing rollers 69.

The arrangement of the image forming apparatus 1 of the tandem type usable in the method of the invention is briefly described above, and the developing device 100 is used as being set in the respective image forming stations 21Y, 21M, 21C, and 21K In FIG. 1, the developing devices are distinguished by colors of toner as with the image forming stations, and numeral references 100Y, 100M, 100C, and 100k are labeled to the respective developing devices. The arrangement is basically the same in each developing device, and a typical arrangement of the developing device 100 will be explained with reference to FIG. 2.

Figure 2:
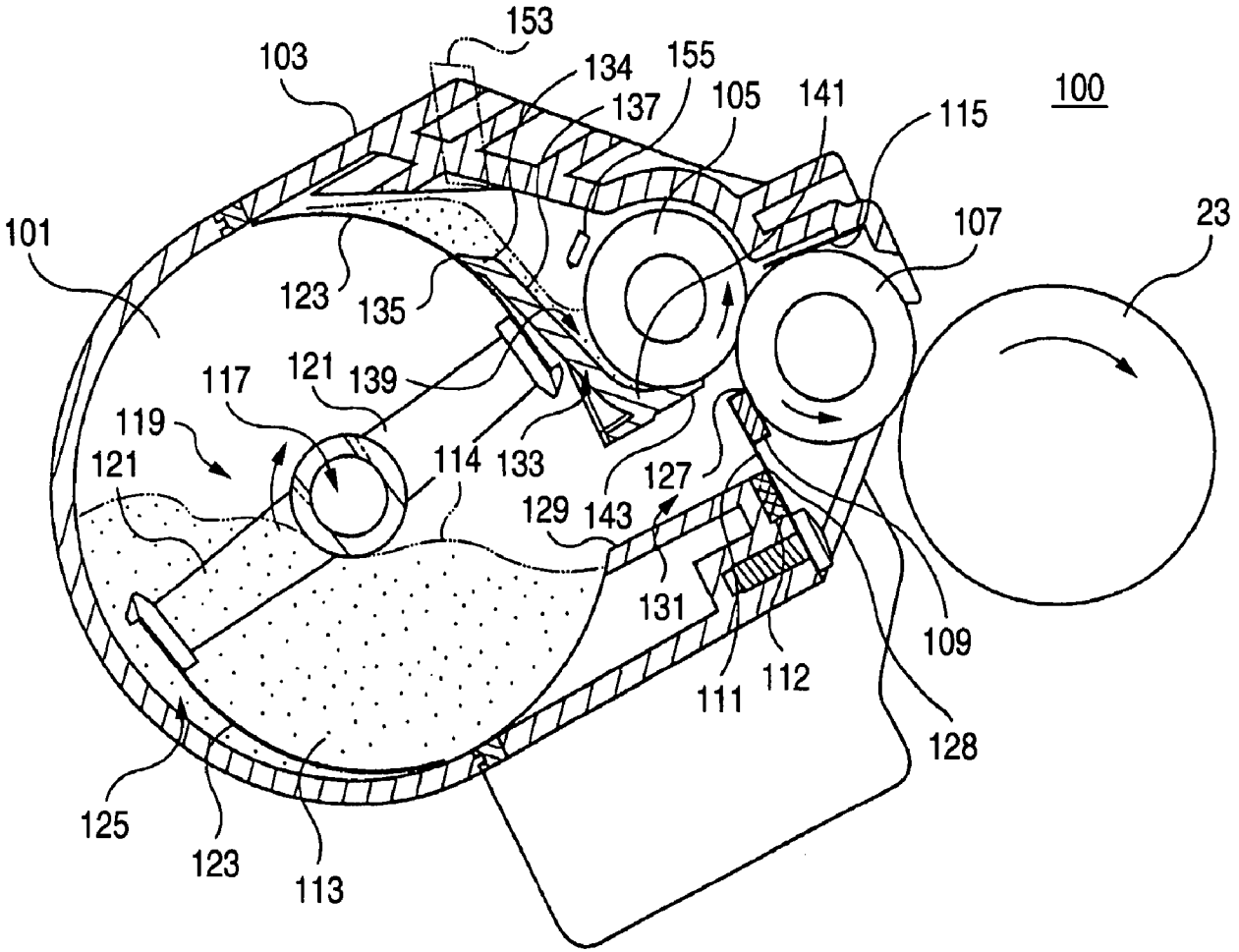
FIG. 2 is a view showing an example of a developing device usable in the developing method of the invention.

FIG. 2 is a cross section of the developing device 100. The developing device 100 includes a housing 103 in which a nearly cylindrical toner container portion 101 is formed, and a supply roller 105 and a developing roller 107 are provided to the housing 103. As shown in FIG. 1, while the developing device 100 is set in the image forming station, the developing roller 107 is placed adjacently to the photosensitive drum 23 while securing a slight interval (for example, 100 to 300 μm). The developing roller 107 has a function of developing a latent image formed on the photosensitive drum 23 with toner supplied on the peripheral surface of the developing roller 107 as it rotates in a direction opposite to the rotational direction of the photosensitive drum 23 (see an arrow of the drawing). Such a developing action takes place when a developing bias, which is a d.c. voltage superimposed with an a.c. voltage, is applied to the developing roller 107 from a developing bias power source (not shown), and toner is supplied from the developing roller 107 to an electrostatic latent image portion formed on the photosensitive drum 23 by the action of a vibrating voltage between the developing roller 107 and the photosensitive drum 23.

The supply roller 105 has a surface made of urethane sponge, and is allowed to rotate in the same direction (in a counterclockwise direction of FIG. 2) in which the developing roller 107 rotates, while the peripheral surface of the supply roller 105 is brought into contact with the developing roller 107. It is arranged in such a manner that a voltage as high as the developing bias voltage to be applied to the developing roller 107 is also applied to the supply roller 105.

The regulating blade 109 constantly press-contacts the developing roller 107 uniformly along the longitudinal direction of the peripheral surface of the developing roller 107 by the action of a plate spring member 111 and an elastic member 112 provided on the lower side of the plate spring member 111. The regulating blade 109 thereby scrapes off extra toner in the toner adhering to the peripheral surface of the developing roller 107, so that a constant quantity of toner is carried on the peripheral surface of the developing roller 107. The regulating blade 109 also has a function of charging toner 113 adequately. Hence, a quantity of charge can be controlled by changing a pressing force of the regulating blade 109, and materials of the developing roller 107 and the regulating blade 109.

The toner thus scraped off naturally falls downward and is mixed into the toner 113 within the toner container portion 101, which will be described below in detail. One end of a sealing member 115 having the other end being fixed to the housing 103 is press-adhered to the upper side of the peripheral surface of the developing roller 107, and this arrangement prevents the toner 113 within the housing 103 from scattering to the outside.

An agitator 119 that rotates about a rotational shaft 117 in a clockwise direction of FIG. 2 is provided inside the toner container portion 101. The agitator 119 is provided with two arm members 121 extending in opposite directions from the rotational shaft 117 at the center, and each arm member 121 is set slightly shorter than a diameter of a circle on the cross section of the toner container portion 101. A stirring fin 123 extends from the tip end of each arm member 121 in a direction opposite to a rotational direction of the agitator 119. Each stirring fin 123 includes a flexible sheet member, and the tip end thereof press-adheres to the inner peripheral surface of the cylindrical toner container portion 101 by an elastic force induced by its own flexibility. According to this arrangement, the toner 113 present in a region 125 between the inner peripheral surface of the toner container portion 101 and the stirring fin 123 is scraped up by the stirring fin 123 as the agitator 119 rotates, and is thereby transported onto a toner guiding member described below.

The top surface 114 of the toner 113 contained within the toner container portion 101 is set at a level lower than a point 127 at which the regulating blade 109 abuts on the peripheral surface of the developing roller 107. This is because when a quantity of the toner 113 is more than enough to burry the regulating blade 109, the toner 113 scraped off by the regulating blade 109 is present near the regulating blade 109, and a circulating path through which the toner 113 is returned into the toner container portion 101 is blocked;

moreover, functions of the regulating blade 109, that is, a function of regulating a quantity of toner to be transported to a developing region by scraping off extra toner from the developing roller 107 and a function of adequately charging the toner, are impaired.

In the developing device 100, the level of the top surface 114 of the toner 113 contained within the toner container portion 101 is set blow the lower end of the regulating blade 109, and the upper limit of the level of the top surface 114 is set at a position of the intersection 128 of the plate spring member 111 and the elastic member 112. When the level of the top surface 114 of the toner 113 within the toner container portion 101 comes above the intersection 128, motions of the plate spring member 111 may possibly be restrained, which may make it impossible to obtain an adequate regulating pressure. As a consequence, "the function of having a constant quantity of toner be carried on the peripheral surface of the developing roller 107" or "the function of charging the toner adequately" may possibly be impaired. However, by setting the upper limit of the level of the top surface 114 of the toner 113 at the position of the intersection 128 as described above, neither function is impaired. As described, it is also possible to send the toner having desired particle size distribution and charge quantity distribution by structurally adjusting the developing device 100 (in particular, the vicinity of the regulating blade 109).

A toner guiding surface 129, which is inclined diagonally toward the top surface 114 of the toner 113 at a tilting angle equal to or greater than an angle of repose of the toner 113, is formed as part of the housing 103 in a space between the point 127 at which the regulating blade 109 abuts on the peripheral surface of the developing roller 107 and the top surface 114 of the toner 113 contained within the toner container portion 101. The toner guiding surface 129 has a function of guiding the toner 113 scraped off from the peripheral surface of the developing roller 107 by the regulating blade 109 toward the toner container portion 101.

A toner guiding space portion 131 is provided below the point 127 at which the regulating blade 109 abuts on the peripheral surface of the developing roller 107. The toner guiding space portion 131 is used to introduce the toner 113 scraped off from the peripheral surface of the developing roller 107 by the regulating blade 109 to the toner container portion 101.

A toner guiding member 133 is provided above the toner container portion 101. The toner guiding member 133 is provided to an end portion 134 on the side away from the supply roller 105. The toner guiding member 133 includes a scraper 135, a flat transportation portion 137, a curved portion 141 and an abutting portion 143. The scraper 135 is formed with an acute angle to scrap off the toner 113 transported by the stirring fins 123. A top surface of the flat transportation portion 137 on the side closer to the supply roller 105 than the scraper 135 is formed flat and is inclined at an angle equal to or greater than an angle of repose of the toner 113. The curved portion 141 is formed on the downstream side of the flat transportation portion 137 with the top surface forming a concave curved surface. The abutting portion 143 comes in contact with the peripheral surface of the supply roller 105 on the downstream side of the curved portion 141 at a pre-set adequate linear load. The surface roughness of the toner guiding member 133 including the flat transportation portion 137, the curved portion 141, and the abutting portion 143 is set to be less than the toner mean particle size.

The toner 113 adhering to the lower surface of the supply roller 105 falls downward by gravity due to the presence of the abutting portion 143, which prevents deterioration in image density caused by a reduction in quantity of the toner 113 that can be supplied to the developing roller 107. A toner temporary reservoir portion 139 is provided in a space between the curved portion 141 and the peripheral surface of the supply roller 105 to have a cross section that narrows wedge-wise.

In the toner guiding member 133 having the shape described as above, after the toner 113 transported by the stirring fins 123 is scraped off by the scraper 135, the toner 113 falls downward at a constant rate by gravity from an arbitrary point in the tilting direction along the flat transportation portion 137 in the width direction, and is stored in the toner temporary reservoir portion 139. In the toner temporary reservoir portion 139 that narrows wedge-wise, a press-adhering force with respect to the peripheral surface of the supply roller 105 gradually increases as the toner 113 moves towards the narrowed region, and the toner 113 is therefore pressed against the peripheral surface of the supply roller 105, which makes it easier for the toner 113 to be carried on the peripheral surface. When the toner 113 is pushed out beyond the abutting portion 143, the toner 113 falls downward through the toner guiding space portion 131, and is returned to the toner container portion 101 directly or by being guided on the toner guiding surface 129.

Image formation by the image forming apparatus 1 and the developing device 100 will now be described.

Image formation is performed as follows.

That is, upon input of an image forming signal from an unillustrated computer or the like, the photosensitive drums 23, the developing rollers 107 in the respective image forming stations 21Y, 21M, 21C, and 21K, and the intermediate transfer belt 33 are rotated. Then, the outer peripheral surface of the photosensitive drum 23 is charged uniformly by the corona charging unit 25, and the outer peripheral surface is exposed selectively by the exposure unit 9 according to image information of a first color, whereby, for example, a yellow electrostatic latent image is obtained. In the toner container portion 101, the toner 113 present in the region 125 between the inner peripheral surface of the toner container portion 101 and the stirring fin 123 is scraped up by the stirring fin 123 by the rotational action of the agitator 119. The toner 113 thus scraped up is scraped off by the scraper 135, and falls downward by sliding on the flat transportation portion 137 to reach the toner temporary reservoir portion 139. The toner 113 stored in the toner temporary reservoir portion 139 is successively carried on the peripheral surface of the supply roller 105, and the toner 113 thus carried later moves onto the developing roller 107. Then, extra toner 113 is scraped off by the regulating blade 109 and the toner 113 carried on the developing roller 107 is charged by the regulating blade 109. The electrostatic latent image formed on the photosensitive drum 23 is thus developed with the charged toner 113. In this instance, the toner 113 is given to the photosensitive drum 23 from the developing roller 107 in the image forming station 21Y, so that a toner image of the yellow electrostatic latent image is formed on the photosensitive drum 23. Further, the toner image thus formed is transferred onto the intermediate transfer belt 33 to which a primary transfer voltage of reverse polarity to the polarity of the charged toner 113 has been applied, after which charges on the outer peripheral surface of the photosensitive drum 23 are erased by a charge erasing unit.

Formation and development of a latent image are repeated in the same manner while the corresponding photosensitive drum 23 and the intermediate transfer belt 33 rotate once for image forming signals of second, third, and fourth colors, respectively, and toner images of four colors corresponding to the contents of the image forming signals are transferred as being superimposed on the intermediate transfer belt 33. Then, the resulting full color image is further transferred onto a recording medium.

Figure 3:
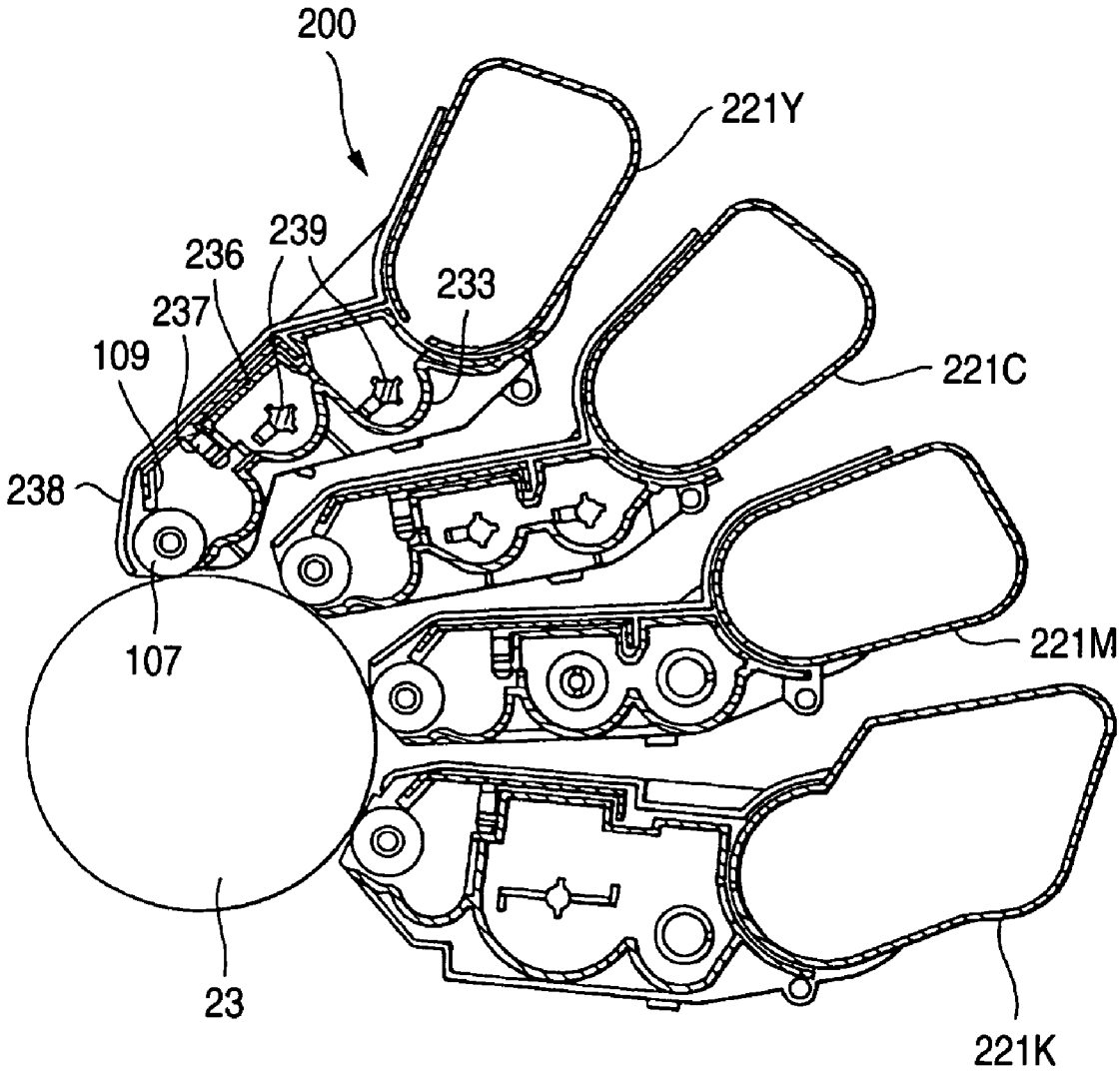
FIG. 3 is a view showing another example of the image forming apparatus usable in the developing method of the invention.

An example of a full-color image forming apparatus 200 equipped with a developing device adopting the contact developing system will now be explained with reference to FIG. 3. The full-color image forming apparatus 200 includes developing device units 221Y, 221C, 221M, and 221K including developing devices for four colors including Y, C, M, and K respectively standing for yellow, cyan, magenta, and black, which are provided in the vicinity of the photosensitive drum 23 in a rotational direction thereof to develop electrostatic latent images. Referring to FIG. 3, numeral 107 denotes a developing roller, numeral 109 denotes a regulating blade, numeral 233 denotes a housing, numeral 236 denotes a blade supporting member, numeral 237 denotes a blade pressing spring, numeral 238 denotes a developing cover, and numeral 239 denotes a stirring shaft. Although it is not shown in the drawing, as shown in FIG. 1, the charging roller as a charging unit, the exposure unit used to form an electrostatic latent image on the photosensitive drum 23, and the intermediate transfer device used to transfer the toner image formed on the photosensitive drum 23 onto the intermediate transfer belt are also provided. In addition, different from the image forming apparatus 1 of FIG. 1, the image forming apparatus 200 includes a cleaning device (not shown) that removes toner remaining on the photosensitive drum 23.

The photosensitive drum 23 includes a conductive base member in the shape of a thin, circular cylinder and a photosensitive layer formed on the surface thereof, and is rotated by an unillustrated driving unit. The developing device units 221Y, 221C, 221M, and 221K are provided so that each is allowed to oscillate with respect to the photosensitive drum 23, and it is arranged in such a manner that the developing roller 107 in only one of the developing devices is allowed to abut on the photosensitive drum 23 while the photosensitive drum 23 rotates once.

In regard to image formation, upon input of an image forming signal from an unillustrated computer or the like, the photosensitive drum 23, the developing rollers 107 in the respective developing device units 221Y, 221C, 221C, and 221K, and the intermediate transfer belt are rotated. The outer peripheral surface of the photosensitive drum 23 is charged uniformly by the charging roller, and the outer peripheral surface is exposed selectively by the exposure unit according to image information of a first color, whereby, for example, a yellow electrostatic latent image is formed. In this instance, the developing roller 107 in the developing device unit 221Y for yellow alone comes in contact with the photosensitive drum 23, whereby a toner image of the yellow electrostatic latent image is formed on the photosensitive drum 23. The toner image thus formed is transferred onto the intermediate transfer belt to which a primary transfer voltage of reverse polarity to the polarity of the charged toner has been applied, and the toner remaining on the photosensitive drum 23 is removed by the cleaning device, after which charges on the outer peripheral surface of the photosensitive drum 23 are erased by a charge erasing unit.

Formation and development of a latent image are repeated in the same manner while the photosensitive drum 23 and the intermediate transfer belt rotate once for image forming signals of second, third, and fourth colors, respectively, and toner images of four colors corresponding to the contents of the image forming signals are transferred as being superimposed on the intermediate transfer belt. Then, the resulting full-color image is further transferred onto a recording medium.

As described, a quantity of charge or the like can be controlled structurally in the developing device also in the image forming apparatus 200 adopting the contact developing method of FIG. 3, by adjusting the arrangement of the regulating blade 109 or the like in the same manner as the image forming apparatus 1 of FIG. 1.

<Function>

The inventor of the invention conducted a study assiduously on the charging characteristic of one-component non-magnetic toner, and discovered that it is important to understand a charge quantity distribution of a given aggregation of toner in relation with a particle size distribution of this particular aggregation of toner, and that a homogenous charging state is achieved on the toner surface when the charge quantity distribution satisfies specific conditions in relation with the particle size distribution.

In short, it is necessary to effect control to satisfy the relation, $B/A \leqq 1$, in the method of the invention. The reason why an image can be formed in a satisfactory manner under this condition remains unclear; however, when the surface of a single toner particle is concerned, in a case where the above-specified condition is satisfied, it is assumed that uniform, ideal charging can take place in the absence of reverse charge in the charge distribution on the surface (for example, a positively charged portion on a negatively charged toner surface). It is thus possible to lessen problems, such as defects in an image due to fogging, scattering, transfer dust, etc., as few as possible.

Also, because most of the toner particles are homogenously charged, transfer efficiency nearly as high as 100% can be achieved, which increase the feasibility of a cleanerless process with reduced waste toner. Hence, not only can the related process be simplified, but also an innovative image forming method achieving both a reduction of the apparatus in size and the improvement in image quality can be provided.

EXAMPLES

The invention will now be described more in detail by way of Examples and Comparative Examples. It should be appreciated, however, that the invention is not limited to the description below.

A particle size and a quantity of charge of the toner were measured in Examples and Comparative Examples below according to the following manipulation procedure using E-SPART Analyzer®, model EST-3 type (manufactured by of Hosokawa Micron Ltd).

<Measuring Procedure by E-SPART Analyzer®>

(1) Turn on the main power of the apparatus, and wait for 30 minutes until the apparatus is stabilized.

(2) Adjust a supply pressure of a nitrogen gas cylinder to 0.3 MPa. Activate a data processing personal computer (PC), and start "ESTWIN902.exe". In this instance, 60 channels are given to a particle size. Then, execute particle size calibration.

(3) Adjust a suction rate at a fixed portion to 0.4 liter/min.

(4) Adjust a collecting air rate to 0.4 liter/min.

(5) Place 150 ml of pure water and add three drops of PSL dispersing liquid in a nebulizer bottle followed by stirring, and place the resulting mixture into an ultrasonic cleaner to allow the reference solution to disperse for two minutes.

(6) Attach a dryer having silica gel and a nitrogen gas supply tube to the nebulizer bottle.

(7) Turn on the calibration switch and wait for 30 sec. until a supply of gas is stabilized.

(8) Adjust a gas pressure to 0.08 MPa.

(9) Click on the start button on the measuring screen of the PC to start measurement.

(10) Confirm that the value at the D50 count and D50 volume is 3.16±0.1 μm after the completion of the measurement (the measurement value is based on a particle size of the PSL reference solution).

(11) Set a supply hood and a nozzle of a one-component supplier and execute charging calibration.

(12) Set a developing roller on which a toner layer is formed in the one-component supplier.

(13) Adjust a distance between the developing roller and the nozzle to 4 mm.

(14) Set charging calibration measuring conditions as follows: suction rate=0.4 liter/min., collecting rate=0.4 liter/min., interval=1 sec., blowing time=1 sec., gas pressure=0.08 MPa, X-axis feeding speed=0.1 mm/sec., and field voltage=0.

(15) Confirm that "Q/mm" on the measuring screen is 0±0.5 μC/g.

(16) Measure sample.

Set a developing roller on which a toner layer is formed in a one-component supplier under the measuring conditions as follows: distance between the developing roller and the nozzle=4 mm, suction rate=0.2 liter/min., collecting rate=0.6 liter/min., interval=3 sec., blowing time=1 sec., gas pressure=0.02 MPa, and field voltage=0.1 kV.

Although a total particle count is not limited, it is preferably 300 or more and 3000 or less. Also, in this instance, it is important to perform measurement by separating toner so that the background of the developing roller will appear after the completion of the measurement.

(17) Perform data processing.

Herein, the individual items of data as to a particle size and a quantity of charge measured in the above method were processed as follows.

With the use of commercially available software (herein, the macro function of EXCEL (registered trademark of Microsoft) was used), a particle size from 0 μm to 10 μm was divided into segments in 0.5 μm steps: 0 μm or greater and less than 0.5 μm, 0.5 μm or grater and less than 1.0 μm, and so forth, and a segment of 0 μm or greater and less 0.5 μm was indicated as 0.25 μm, and a segment of 0.5 μm or greater and less than 1.0 μm was indicated as 0.75 μm, and so forth.

Likewise, a quantity of charge was divided into segments: 0 fC or greater and less than 0.5 fC, 0.5 fC or greater and less than 1.0 fC, . . . , −0.5 fC or greater and less than 0 fC, −1.0 fC or greater and less than −0.5 fC, and so forth. The segment of 0 fC or greater and less than 0.5 fC was indicated as 0.25, the segment of 0.5 fC or greater and less than 1.0 fC was indicated as 0.75, and so forth, . . . , the segment of −0.5 fC or greater and less than 0 fC was indicated as −0.25, the segment of −1.0 fC or greater and less than −0.5 fC was indicated as −0.75, and so forth.

The measurement data was organized in the above manner, and further, a particle count in each channel was divided by the total particle count thus measured, and 3-D graphs (see FIG. 4 and the like), each representing a particle count ratio, were created. Herein, segments having a particle count accounting for less than 1% were omitted from the graphs.

Example 1

A monomer mixture composed of 80 parts by weight of styrene monomer, 20 parts by weight of butyl acrylate, and 5 parts by weight of acrylic acid was added to a water-soluble mixture composed of 105 parts by weight of water, 1 part by weight of a nonionic emulsifier, 1.5 parts by weight of an anionic emulsifier, and 0.55 part by weight of potassium persulfate, and the resulting mixture was kept stirred for eight hours at 70° C. under a nitrogen flow. The resulting mixture was cooled after a polymerization reaction, and translucent resin emulsion having a particle size of 0.25 μm was obtained.

Then, 200 parts by weight of the resin emulsion, 20 parts by weight of polyethylene wax emulsion (manufactured by Sanyo Chemical Industries, Ltd.), 7 parts by weight of copper phthalocyanine blue were dispersed in water containing 0.2 part by weight of sodium dodecylbenzene sulfonate used as a surfactant. Then, after a pH was adjusted to 5.5 by adding diethylamine, 0.3 part by weight of electrolytic aluminum sulfate was added with stirring, after which the resulting mixture was dispersed with stirring at a high speed in a TK homo-mixer. Further, 40 parts by weight of styrene monomer, 10 parts by weight of butyl acrylate, and 5 parts by weight of zinc salicylate were added together with 40 parts by weight of water, and the resulting mixture was heated at 90° C. with stirring under a nitrogen flow in the same manner as above. Then, hydrogen peroxide was added and the resulting mixture was allowed to undergo polymerization for five hours, so that particles were grown. After the polymerization was ended, in order to improve a bonding strength among associated particles, a pH was adjusted to 5 or higher while a temperature was raised to 95° C., under which condition the particles were maintained for five hours. Then, the particles thus obtained were rinsed with water followed by vacuum drying at 45° C. for ten hours.

The toner base particles manufactured through the emulsification polymerization to have a mean particle size of 7 microns and a circularity of 0.975 were added with 0.7% by weight of silica of a large particle size (RX50: available from Nippon Aerosil Co., Ltd.), 1.0% by weight of silica of a small particle size (RX300: available from Nippon Aerosil Co., Ltd.), and 0.5% by weight of titanium (STT30S: available from Titan Kogyo Kabushiki Kaisha), and the resulting mixture was processed for two minutes in a compact agitator at a rotation number of 2000 rpm.

Figure 4:
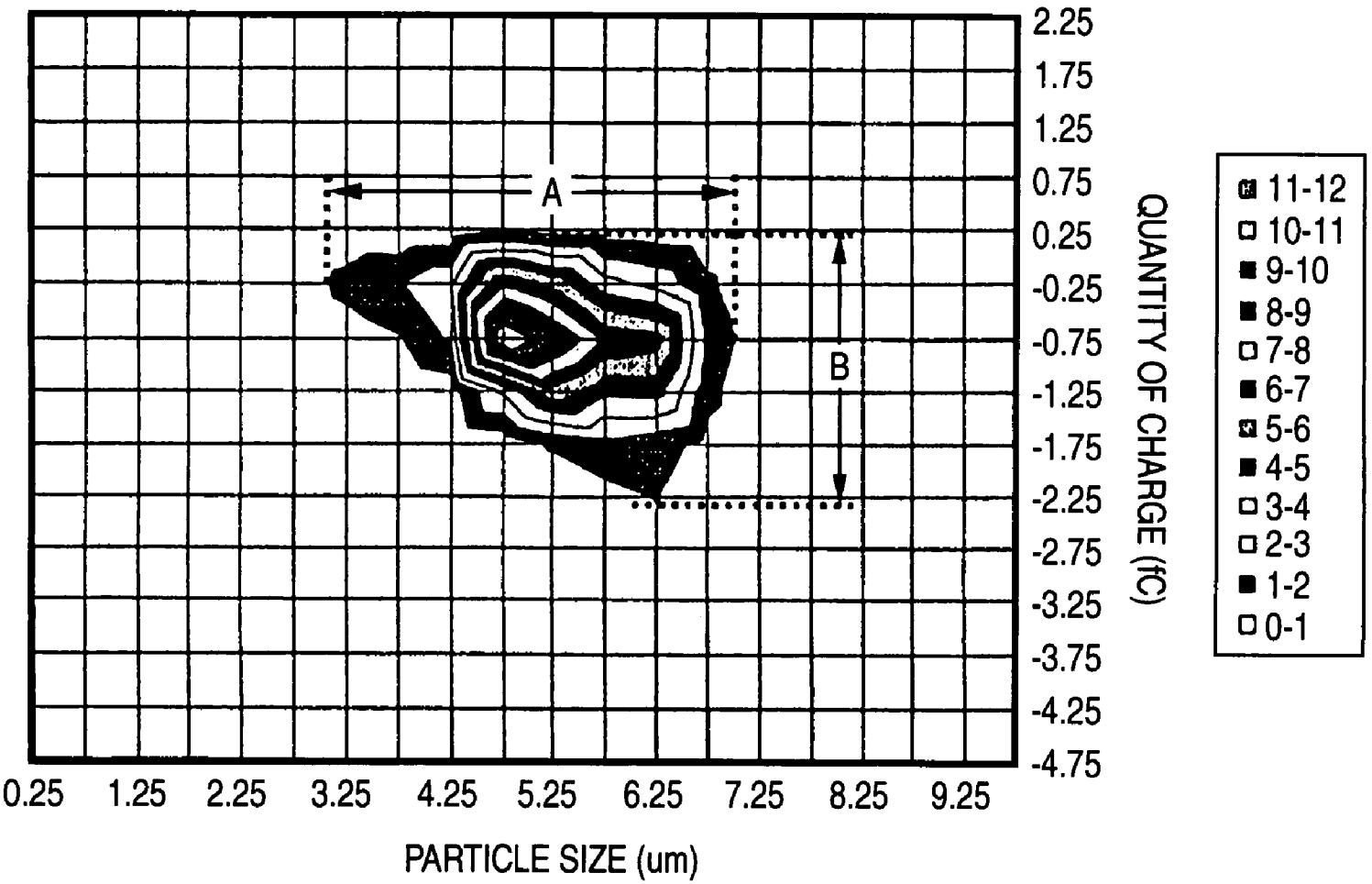
FIG. 4 is a view showing a particle size-to-charge quantity distribution in Example 1.

The toner thus obtained was negatively charged in the developing device of the non-contact system as the one shown in FIG. 2. A quantity of toner being transported when the regulating blade passes by was set to 0.35 mg/cm$^2$. Then, a particle size and a quantity of charge were measured for approximately 3000 charged toner particles. The measurement result is set forth in FIG. 4. FIG. 4 reveals that, given A (in FIG. 4) as the width of a particle size distribution (unit: μm) and B (in FIG. 4) as the width of a charge quantity distribution (unit: fC) of the toner, then B/A was 0.7. As previously mentioned, FIG. 4 shows data for only the segments having a toner particle count accounting for 1% (that is, approximately 30 particles in FIG. 4) or higher of the total from all the segments defined by a particle size in 0.5 μm steps and a quantity of charge in 0.5 fC steps.

Also, details of a particle size and a charge quantity distribution are represented in Table 1 below. Table 1 shows that, given a as the particle size segment having the largest particle count in the toner particle size distribution and b as the particle size segment having the largest particle count in the particle size distribution in every charge quantity segment, then a=5.25 (segment having 682 particles), and b=4.75 (segment having 332 particles), that is, the relation between a and b was expressed as a>b. In the case of the toner in this example, as can be understood from Table 1, the positively charged toner particle count, that is, toner of reverse polarity, was 123 out of the total of 2994, which accounted for 4.1%. Further, the toner particle count in the quantity charge segment having the largest particle count in the charge quantity distribution in every particle size segment was 332, which accounted for 10% or higher of the total toner.

TABLE 1

| | | QUANTITY OF CHARGE (fC) | | | | | | | | | | | | | | | |
|---|---|---|---|---|---|---|---|---|---|---|---|---|---|---|---|---|---|
| | | −4.75 | −4.25 | −3.75 | −3.25 | −2.75 | −2.25 | −1.75 | −1.25 | −0.75 | −0.25 | 0.25 | 0.75 | 1.25 | 1.75 | 2.25 | |
| PARTICLE SIZE (μm) | 0.25 | 0 | 0 | 0 | 0 | 0 | 0 | 0 | 0 | 0 | 0 | 0 | 0 | 0 | 0 | 0 | 0 |
| | 0.75 | 0 | 0 | 0 | 0 | 0 | 0 | 0 | 0 | 0 | 0 | 1 | 0 | 0 | 0 | 0 | 1 |
| | 1.25 | 0 | 0 | 0 | 0 | 0 | 0 | 0 | 0 | 0 | 0 | 1 | 0 | 0 | 0 | 0 | 1 |
| | 1.75 | 0 | 0 | 0 | 0 | 0 | 0 | 0 | 0 | 0 | 0 | 1 | 0 | 0 | 0 | 0 | 1 |
| | 2.25 | 0 | 0 | 0 | 0 | 0 | 0 | 0 | 0 | 0 | 3 | 2 | 0 | 0 | 0 | 0 | 5 |
| | 2.75 | 0 | 0 | 0 | 0 | 0 | 0 | 0 | 0 | 2 | 13 | 2 | 0 | 0 | 0 | 0 | 17 |
| | 3.25 | 0 | 0 | 0 | 0 | 0 | 0 | 0 | 0 | 14 | 39 | 9 | 0 | 0 | 0 | 0 | 62 |
| | 3.75 | 0 | 0 | 0 | 0 | 0 | 0 | 0 | 3 | 27 | 57 | 7 | 0 | 0 | 0 | 0 | 94 |
| | 4.25 | 0 | 0 | 0 | 0 | 1 | 0 | 1 | 15 | 64 | 85 | 10 | 0 | 0 | 0 | 0 | 176 |
| | 4.75 | 0 | 0 | 0 | 0 | 1 | 0 | 11 | 96 | 332 | 207 | 28 | 0 | 0 | 0 | 0 | 673 |
| | 5.25 | 0 | 0 | 0 | 2 | 2 | 2 | 34 | 172 | 280 | 172 | 18 | 0 | 0 | 0 | 0 | 682 |
| | 5.75 | 0 | 2 | 0 | 2 | 9 | 19 | 52 | 128 | 205 | 101 | 17 | 0 | 0 | 0 | 0 | 535 |
| | 6.25 | 0 | 3 | 0 | 4 | 22 | 31 | 43 | 132 | 192 | 80 | 14 | 1 | 0 | 0 | 0 | 522 |
| | 6.75 | 1 | 2 | 2 | 5 | 7 | 10 | 19 | 40 | 51 | 36 | 10 | 2 | 0 | 0 | 0 | 185 |
| | 7.25 | 0 | 0 | 0 | 1 | 1 | 1 | 1 | 2 | 10 | 5 | 1 | 0 | 0 | 0 | 0 | 22 |
| | 7.75 | 0 | 0 | 0 | 0 | 1 | 0 | 1 | 3 | 1 | 3 | 0 | 1 | 0 | 0 | 0 | 10 |
| | 8.25 | 0 | 0 | 0 | 0 | 0 | 0 | 0 | 1 | 0 | 1 | 0 | 0 | 0 | 0 | 0 | 2 |
| | 8.75 | 0 | 0 | 0 | 0 | 0 | 1 | 0 | 0 | 1 | 1 | 0 | 0 | 0 | 0 | 0 | 3 |
| | 9.25 | 0 | 0 | 0 | 0 | 0 | 0 | 0 | 0 | 0 | 0 | 0 | 0 | 0 | 0 | 0 | 0 |
| | 9.75 | 0 | 0 | 0 | 0 | 0 | 0 | 0 | 1 | 1 | 1 | 0 | 0 | 0 | 0 | 0 | 3 |
| | | 1 | 7 | 2 | 14 | 44 | 64 | 162 | 593 | 1180 | 804 | 119 | 4 | 0 | 0 | 0 | 2994 |
| | | | | | | | | | | | | | | | | 2994 | |

POSITIVELY CHARGED PARTICLE COUNT: 123

Subsequently, a toner image was formed on the photosensitive body with the use of a similar developing device through a non-contact system by superimposing an a.c. component, Vpp=1.3 Kv, on a d.c. component, Vdc=300 V. Then, it was possible to form an image at development efficiency as high as or higher than 90% while hardly causing fogging toner and scattering. Further, image formation was performed with the use of the image forming apparatus 1 of FIG. 1. Then, primary transfer efficiency from the photosensitive body to the intermediate transfer medium was 99.9% or higher, and a reduction of waster toner and image formation (cleaner-less process) by a cleaner-less image forming apparatus were thus achieved.

Comparative Example 1

The same toner base particles as those used in Example 1 were used, and toner was manufactured through the same manipulations as in Example 1 by using, as extraneous additives, 0.5% by weight of silica (RX50: available from Nippon Aerosil Co., Ltd) done with hexamethyldisilazane (hereinafter abbreviated to HMDS) treatment and having a primary particle size of 40 nm, and 0.5% by weight of silica (RX300: available from Nippon Aerosil Co., Ltd.) done with HMDS treatment and having a primary particle size of 7 nm.

Figure 5:
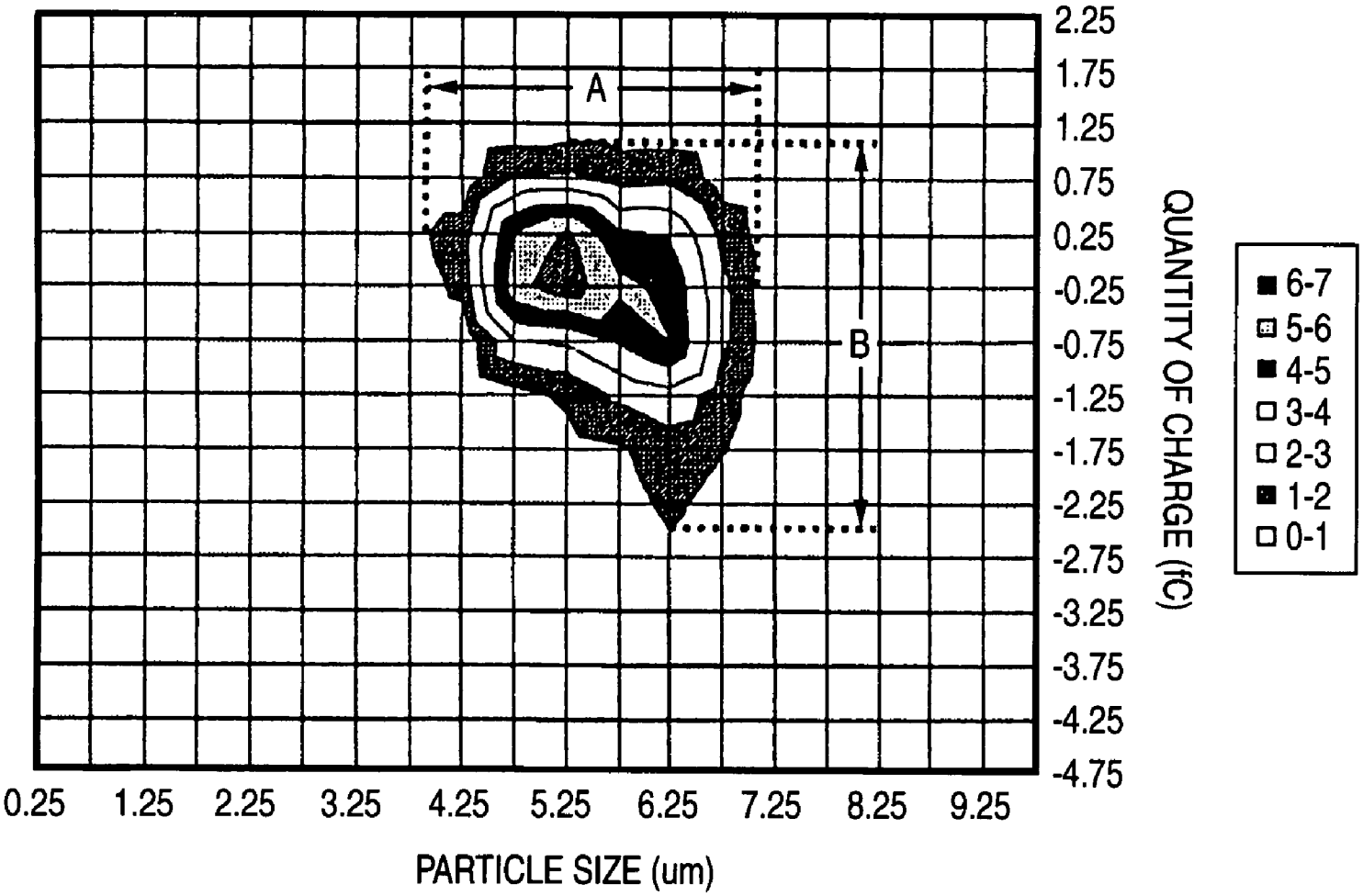
FIG. 5 is a view showing a particle size-to-charge quantity distribution in Comparative Example 1.

The toner thus obtained was negatively charged in the same manner as in Example 1, and a particle size distribution and a charge quantity distribution were measured. The measurement result is set forth in FIG. 5. Given A as the width of a particle size distribution and B as the width of a charge quantity distribution of the toner, then B/A was 1.16. Also, development was performed using the toner thus obtained in the same manner as in Example 1. Then, development efficiency was reduced to 50% or below under the developing condition of Example 1, and the occurrences of fogging and scattering were acknowledged. Further, primary transfer efficiency from the photosensitive body confirmed in the same manner as in Example 1 was approximately 90%, which was too low to achieve a cleaner-less process, and waste toner was increased.

Example 2

Figure 6:
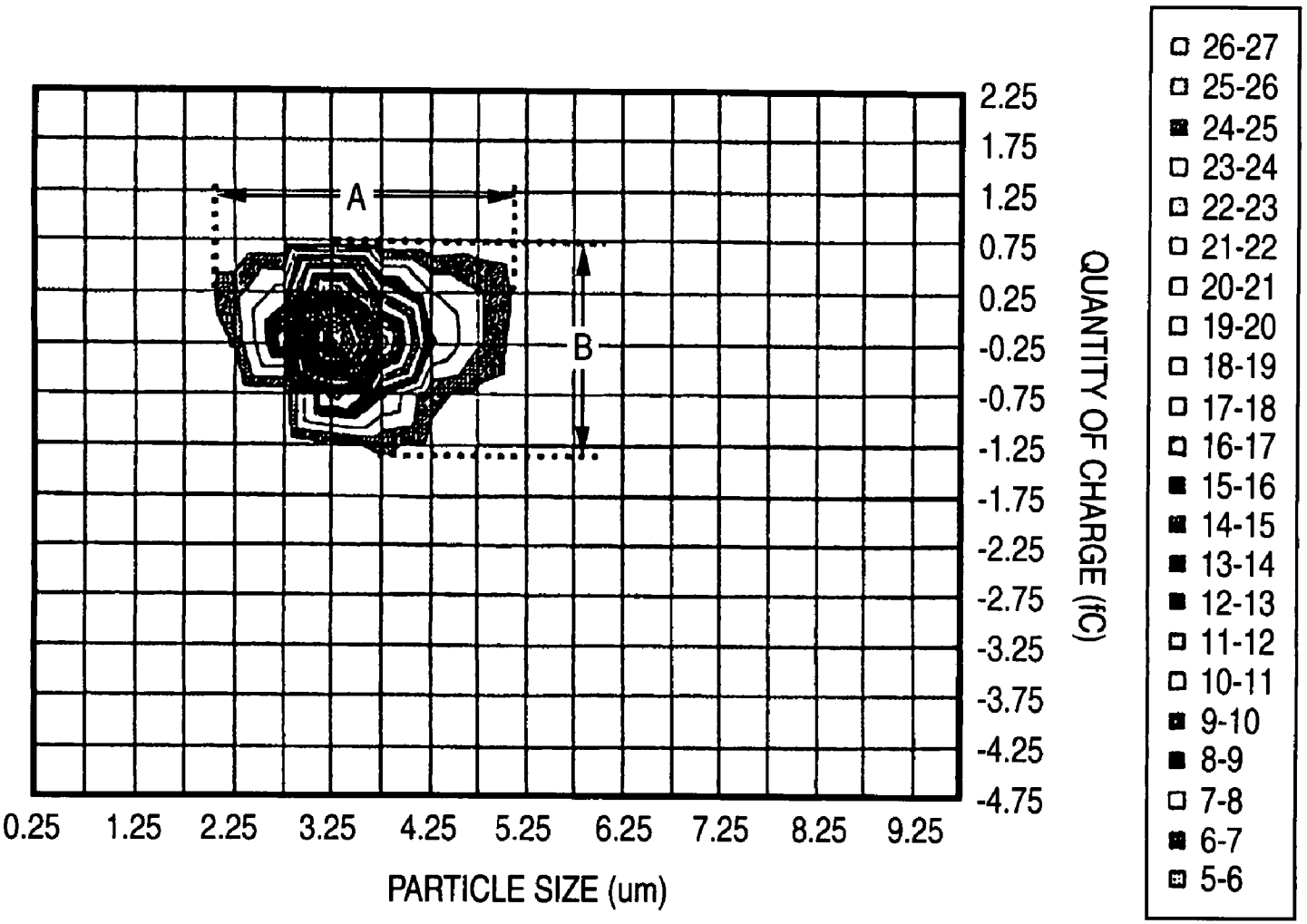
FIG. 6 is a view showing a particle size-to-charge quantity distribution in Example 2.

Toner was manufactured in the same manner as in Example 1 except that toner base particles having a count mean particle size of 5 μm were used, and only 1.0% by weight of titanium (STT30S: available from Titan Kogyo Kabushiki Kaisha) was used as an extraneous additive. The toner thus obtained was negatively charged in a developing device of the non-contact system in the same manner as Example 1. A quantity of toner being transported when the regulating blade passes by was set to 0.25 mg/cm$^2$. A particle size and a quantity of charge were measured for approximately 3000 charged toner particles. The measurement result is set forth in FIG. 6. FIG. 6 shows that the width A of the particle size distribution and the width B of the charge quantity distribution of the toner were 3 and 2.2, respectively, and B/A was 0.73. Also, development was performed by using the toner thus obtained in the same manner as in Example 1, and development efficiency of 80% or higher was achieved, while causing neither fogging nor scattering. A satisfactory developing characteristic was thus achieved.

Comparative Example 2

Figure 7:
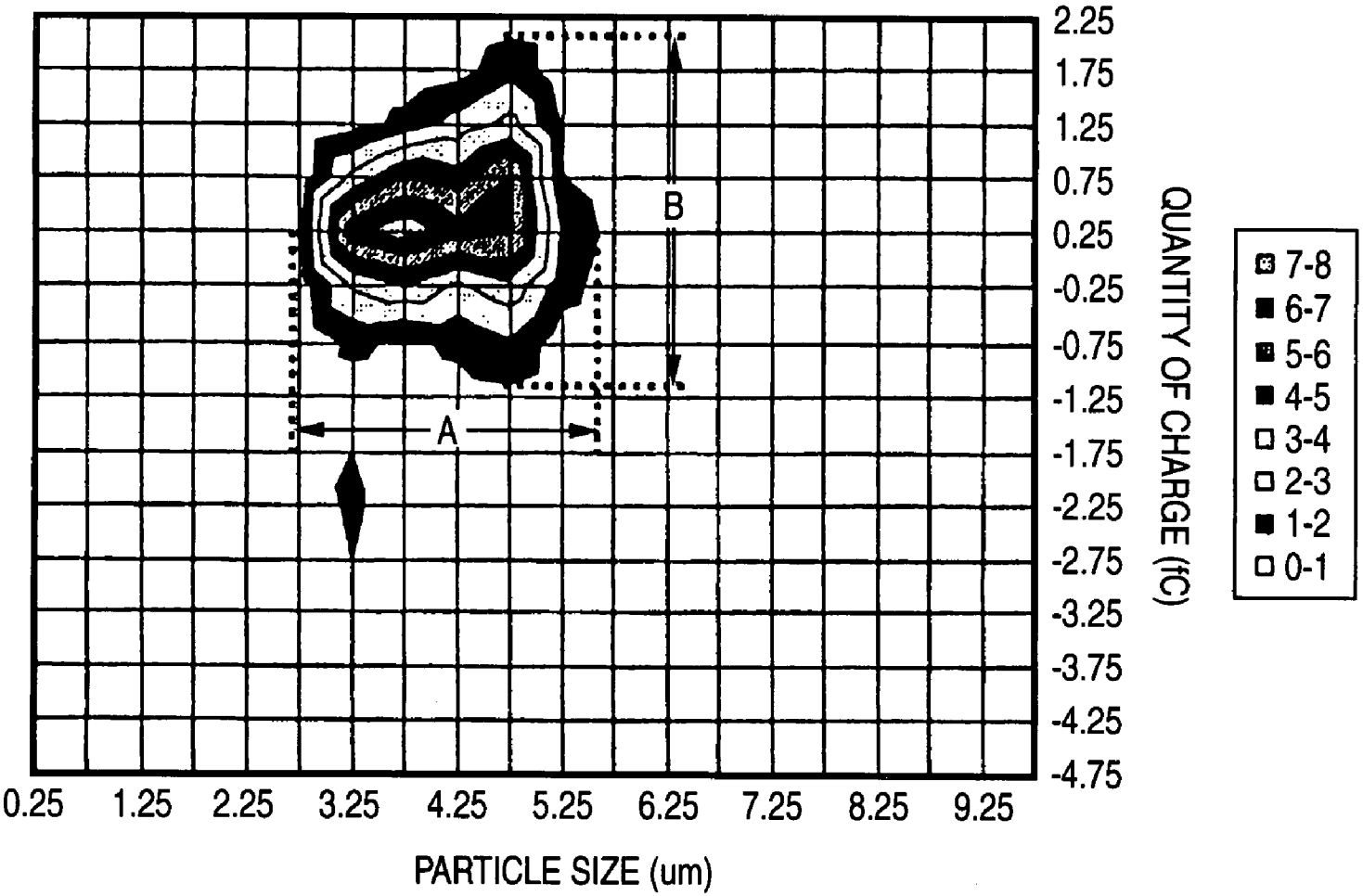
FIG. 7 is a view showing a particle size-to-charge quantity distribution in Comparative Example 2.

Toner was manufactured in the same manner as in Example 2 except that only 0.1% by weight of silica of a small particle size (RX300: available from Nippon Aerosil Co., Ltd.) was used as an extraneous additive instead of titanium. The toner thus obtained was negatively charged in the same manner as in Example 2. A particle size and a quantity of charge were measured for approximately 3000 charged toner particles. The measurement result is set forth in FIG. 7. FIG. 7 reveals that the width A of the particle size distribution and the width B of the charge quantity distribution of the toner were 2.63 and 3.18, respectively, and B/A was 1.21. Also, development was performed in the same manner as in Example 2 by using the toner thus obtained, and development efficiency was as low as or lower than 30%, and fogging and scattering were caused.

Example 3

Figure 8:
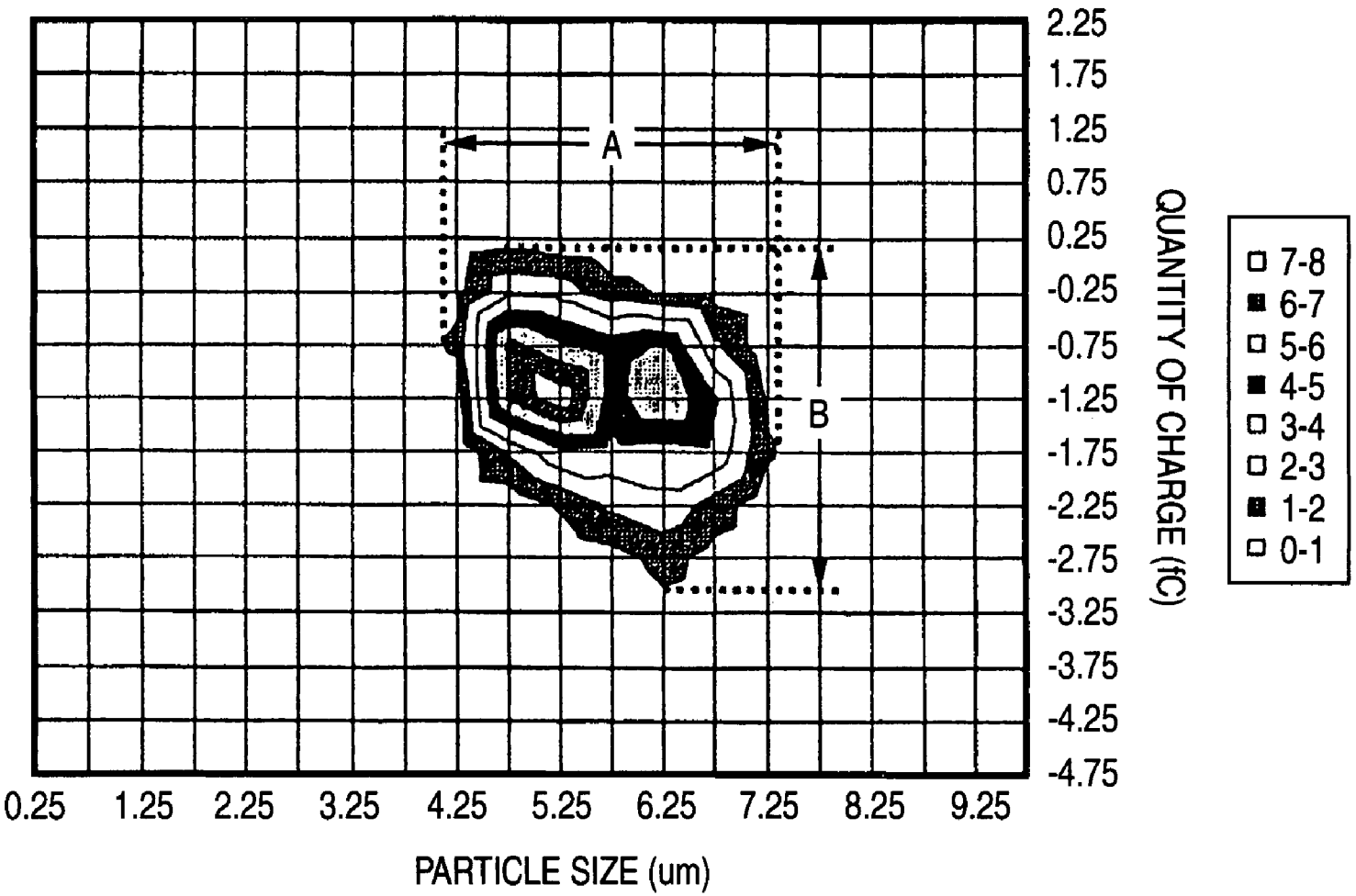
FIG. 8 is a view showing a particle size-to-charge quantity distribution in Example 3.

Toner was manufactured in the same manner as in Example 1 except that resin X, different from the one used in Example 1, was used as resin of toner base particles. The toner thus obtained was negatively charged in a developing device of the non-contact system in the same manner as in Example 1. A quantity of toner being transportation when the regulating blade passes by was set to 0.35 mg/cm$^2$. A particle size and a quantity of charge were measured for approximately 3000 charged toner particles. The measurement result is set forth in FIG. 8. FIG. 8 reveals that the width A of the particle size distribution and the width B of the charge quantity distribution of the toner were 3.25 and 3.17, respectively, and B/A was 0.98.

Details of a particle size and a charge quantity distribution are set forth in Table 2 below. Table 2 shows that a positively charged toner particle count, that is, toner of reverse polarity, was 47 out of the total of 2992, which accounted for 1.6%.

TABLE 2

| | | QUANTITY OF CHARGE (fC) | | | | | | | | | | | | | | | |
|---|---|---|---|---|---|---|---|---|---|---|---|---|---|---|---|---|---|
| | | −4.75 | −4.25 | −3.75 | −3.25 | −2.75 | −2.25 | −1.75 | −1.25 | −0.75 | −0.25 | 0.25 | 0.75 | 1.25 | 1.75 | 2.25 | |
| PARTICLE SIZE (μm) | 0.25 | 0 | 0 | 0 | 0 | 0 | 0 | 0 | 0 | 0 | 0 | 0 | 0 | 0 | 0 | 0 | 0 |
| | 0.75 | 0 | 0 | 0 | 0 | 0 | 0 | 0 | 0 | 0 | 0 | 0 | 0 | 0 | 0 | 0 | 0 |
| | 1.25 | 0 | 0 | 0 | 0 | 0 | 0 | 0 | 0 | 0 | 0 | 0 | 0 | 0 | 0 | 0 | 0 |
| | 1.75 | 0 | 0 | 0 | 0 | 0 | 0 | 0 | 0 | 0 | 0 | 1 | 0 | 0 | 0 | 0 | 1 |
| | 2.25 | 0 | 0 | 0 | 0 | 0 | 0 | 0 | 0 | 0 | 0 | 0 | 0 | 0 | 0 | 0 | 0 |
| | 2.75 | 0 | 0 | 0 | 0 | 0 | 0 | 0 | 0 | 0 | 0 | 0 | 0 | 0 | 0 | 0 | 0 |
| | 3.25 | 0 | 0 | 0 | 0 | 0 | 0 | 0 | 0 | 3 | 8 | 0 | 0 | 0 | 0 | 0 | 11 |
| | 3.75 | 0 | 0 | 0 | 0 | 0 | 0 | 0 | 2 | 12 | 3 | 1 | 0 | 0 | 0 | 0 | 18 |
| | 4.25 | 0 | 0 | 0 | 0 | 0 | 0 | 2 | 15 | 35 | 22 | 10 | 0 | 0 | 0 | 1 | 85 |
| | 4.75 | 0 | 0 | 0 | 0 | 2 | 8 | 66 | 187 | 189 | 83 | 18 | 0 | 0 | 0 | 0 | 553 |
| | 5.25 | 0 | 1 | 1 | 0 | 7 | 33 | 114 | 231 | 158 | 78 | 7 | 0 | 0 | 0 | 0 | 630 |
| | 5.75 | 0 | 0 | 0 | 3 | 18 | 66 | 110 | 137 | 136 | 42 | 1 | 1 | 0 | 0 | 0 | 514 |
| | 6.25 | 2 | 2 | 12 | 21 | 40 | 81 | 107 | 177 | 155 | 27 | 4 | 0 | 0 | 0 | 0 | 628 |
| | 6.75 | 4 | 4 | 11 | 14 | 19 | 46 | 113 | 125 | 66 | 19 | 2 | 1 | 0 | 0 | 0 | 424 |
| | 7.25 | 4 | 1 | 3 | 0 | 5 | 9 | 34 | 25 | 8 | 5 | 0 | 0 | 0 | 0 | 0 | 94 |
| | 7.75 | 0 | 0 | 0 | 1 | 1 | 5 | 4 | 9 | 1 | 0 | 0 | 0 | 0 | 0 | 0 | 21 |
| | 8.25 | 0 | 0 | 0 | 0 | 2 | 0 | 0 | 0 | 0 | 0 | 0 | 0 | 0 | 0 | 0 | 2 |
| | 8.75 | 0 | 0 | 2 | 2 | 0 | 3 | 1 | 0 | 2 | 0 | 0 | 0 | 0 | 0 | 0 | 10 |
| | 9.25 | 0 | 0 | 0 | 0 | 0 | 0 | 0 | 0 | 0 | 0 | 0 | 0 | 0 | 0 | 0 | 0 |
| | 9.75 | 0 | 0 | 0 | 0 | 0 | 1 | 0 | 0 | 0 | 0 | 0 | 0 | 0 | 0 | 0 | 1 |
| | | 10 | 8 | 29 | 41 | 94 | 252 | 551 | 908 | 765 | 287 | 44 | 2 | 0 | 0 | 1 | 2992 |
| | | | | | | | | | | | | | | | | 2992 | |

POSITIVELY CHARGED PARTICLE COUNT: 47

Development was performed in the same manner as in Example 1 by using the toner thus obtained, and development efficiency of 80% or higher was achieved, while causing neither fogging nor scattering. A satisfactory developing characteristic was thus achieved.

Comparative Example 3

Figure 9:
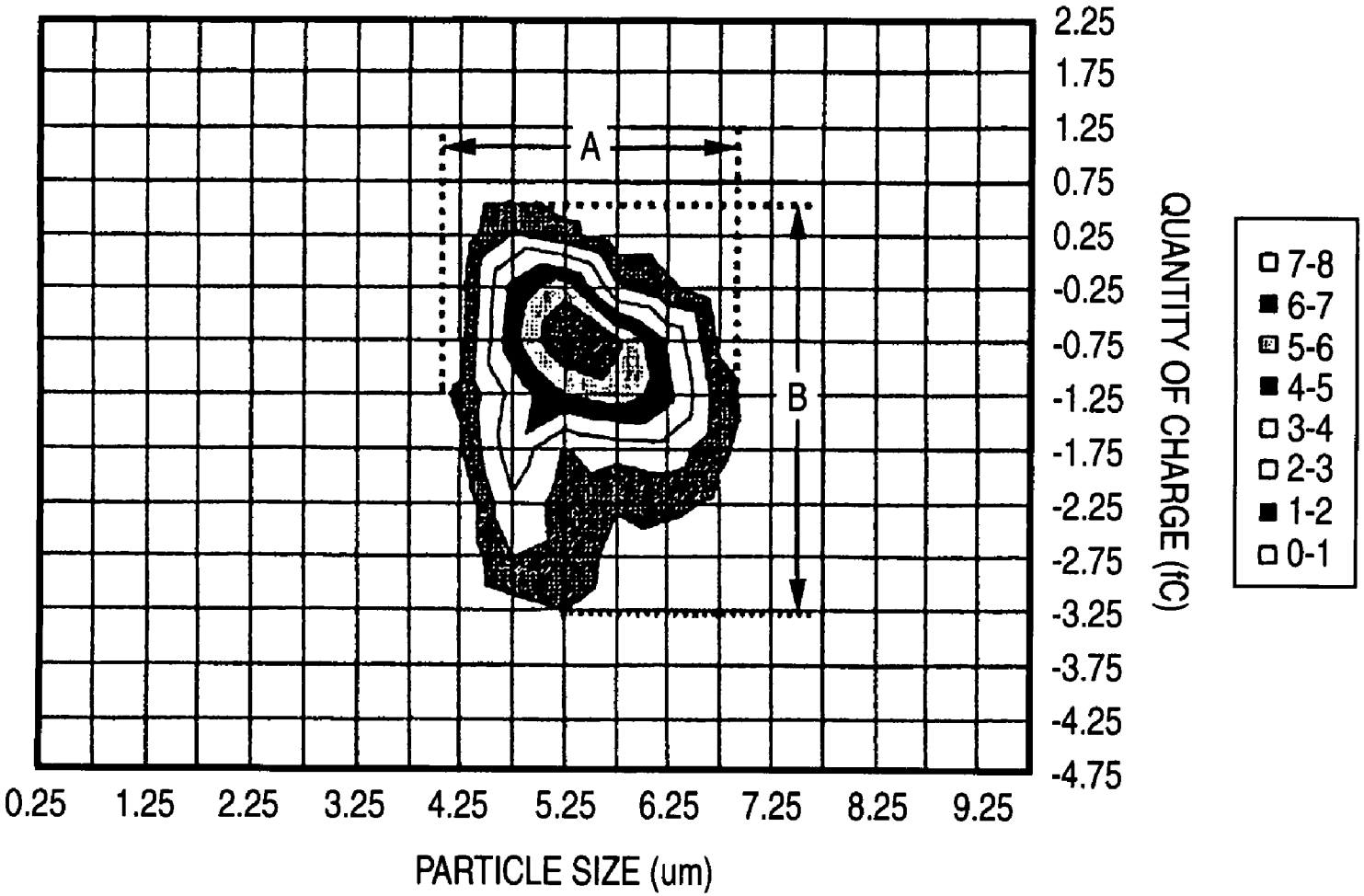
FIG. 9 is a view showing a particle size-to-charge quantity distribution in Comparative Example 3.

Toner, containing the resin X also used in Example 3 in the base particles, was negatively charged in a developing device of the non-contacting system in the same manner as in Example 3. It should be noted, however, that a quantity of toner being transported when the regulating blade passes by was set to 0.6 mg/cm$^2$. A particle size and a quantity of charge were measured for approximately 3000 charged toner particles. The measurement result is set forth in FIG. 9. FIG. 9 reveals that the width A of the particle size distribution and the width B of the charge quantity distribution of the toner were 2.75 and 3.8, respectively, and B/A was 1.39.

Details of a particle size and a charge quantity distribution are set forth in Table 3 below. Table 3 reveals that a positively charged toner particle count, that is, toner of reverse polarity, was 175 out of the total of 2994, which accounted for 5.8%.

TABLE 3

| | | QUANTITY OF CHARGE (fC) | | | | | | | | | | | | | | | |
|---|---|---|---|---|---|---|---|---|---|---|---|---|---|---|---|---|---|
| | | −4.75 | −4.25 | −3.75 | −3.25 | −2.75 | −2.25 | −1.75 | −1.25 | −0.75 | −0.25 | 0.25 | 0.75 | 1.25 | 1.75 | 2.25 | |
| PARTICLE SIZE (μm) | 0.25 | 0 | 0 | 0 | 0 | 0 | 0 | 0 | 0 | 0 | 0 | 0 | 0 | 0 | 0 | 0 | 0 |
| | 0.75 | 0 | 0 | 0 | 0 | 0 | 0 | 0 | 0 | 0 | 0 | 1 | 0 | 0 | 0 | 0 | 1 |
| | 1.25 | 0 | 0 | 0 | 0 | 0 | 0 | 0 | 0 | 0 | 0 | 0 | 0 | 0 | 0 | 0 | 0 |
| | 1.75 | 0 | 0 | 0 | 0 | 0 | 0 | 0 | 0 | 0 | 1 | 1 | 0 | 0 | 0 | 0 | 2 |
| | 2.25 | 0 | 0 | 0 | 0 | 0 | 0 | 0 | 1 | 0 | 3 | 2 | 0 | 0 | 0 | 0 | 6 |
| | 2.75 | 0 | 0 | 0 | 0 | 0 | 0 | 0 | 0 | 0 | 3 | 1 | 1 | 1 | 0 | 0 | 6 |
| | 3.25 | 0 | 0 | 0 | 0 | 0 | 0 | 0 | 3 | 8 | 11 | 4 | 1 | 0 | 0 | 0 | 27 |
| | 3.75 | 0 | 0 | 0 | 0 | 0 | 3 | 8 | 17 | 14 | 10 | 7 | 3 | 0 | 0 | 0 | 62 |
| | 4.25 | 0 | 0 | 1 | 1 | 7 | 8 | 27 | 33 | 21 | 20 | 11 | 4 | 0 | 0 | 0 | 133 |
| | 4.75 | 0 | 2 | 10 | 17 | 61 | 84 | 110 | 98 | 140 | 129 | 63 | 5 | 0 | 0 | 0 | 719 |
| | 5.25 | 1 | 12 | 25 | 31 | 50 | 47 | 59 | 150 | 212 | 171 | 41 | 4 | 0 | 1 | 0 | 804 |
| | 5.75 | 3 | 5 | 6 | 16 | 21 | 32 | 72 | 168 | 186 | 66 | 9 | 0 | 0 | 0 | 0 | 584 |

TABLE 3-continued

| | QUANTITY OF CHARGE (fC) | | | | | | | | | | | | | | | |
|---|---|---|---|---|---|---|---|---|---|---|---|---|---|---|---|---|
| | −4.75 | −4.25 | −3.75 | −3.25 | −2.75 | −2.25 | −1.75 | −1.25 | −0.75 | −0.25 | 0.25 | 0.75 | 1.25 | 1.75 | 2.25 | |
| 6.25 | 4 | 3 | 2 | 10 | 16 | 38 | 79 | 132 | 119 | 36 | 10 | 1 | 0 | 0 | 0 | 450 |
| 6.75 | 0 | 0 | 1 | 2 | 4 | 24 | 35 | 41 | 26 | 10 | 1 | 1 | 0 | 0 | 0 | 145 |
| 7.25 | 0 | 0 | 0 | 0 | 2 | 6 | 13 | 8 | 5 | 3 | 1 | 1 | 0 | 0 | 0 | 39 |
| 7.75 | 0 | 0 | 1 | 0 | 1 | 4 | 2 | 4 | 1 | 2 | 0 | 0 | 0 | 0 | 0 | 15 |
| 8.25 | 0 | 0 | 0 | 0 | 1 | 0 | 0 | 0 | 0 | 0 | 0 | 0 | 0 | 0 | 0 | 1 |
| 8.75 | 0 | 0 | 0 | 0 | 0 | 0 | 0 | 0 | 0 | 0 | 0 | 0 | 0 | 0 | 0 | 0 |
| 9.25 | 0 | 0 | 0 | 0 | 0 | 0 | 0 | 0 | 0 | 0 | 0 | 0 | 0 | 0 | 0 | 0 |
| 9.75 | 0 | 0 | 0 | 0 | 0 | 0 | 0 | 0 | 0 | 0 | 0 | 0 | 0 | 0 | 0 | 0 |
| | 8 | 22 | 46 | 77 | 163 | 246 | 405 | 655 | 732 | 465 | 152 | 21 | 1 | 1 | 0 | 2994 |
| | | | | | | | | | | | | | | | 2994 | |

POSITIVELY CHARGED PARTICLE COUNT: 175

Also, development was performed in the same manner as in Example 1 by using the toner thus obtained, and development efficiency was as low as or lower than 40%, and fogging and scattering were caused.

While various embodiments of the invention have been described, the invention is not limited to the embodiments above, and can be applied to other embodiments within the scope of the invention described in the appended claims.

What is claimed is:

1. A developing method, comprising the steps of:

carrying one-component non-magnetic toner on a developer carrier;

pressing the one-component non-magnetic toner by a regulating member so as to regulate a transporting quantity of the one-component non-magnetic toner and to charge the one-component non-magnetic toner;

forming an electrostatic latent image on an image carrier;

providing the one-component non-magnetic toner to the electrostatic latent image so as to convert the electrostatic latent image into a visible toner image; and controlling the one-component non-magnetic toner on the developer carrier so that the one-component non-magnetic toner pressed by the regulating member satisfies the following relationship:

$$B/A \leqq 1$$

where A represents a width [μm] of a particle size distribution of the one-component non-magnetic toner; and B represents a width [fC] of a charge quantity distribution of the one-component non-magnetic toner.

2. The developing method as set forth in claim 1, wherein the control step is performed to satisfy the following relationship;

$$a>b$$

where a represents a particle size [μm] in a particle size segment having a largest particle count in the particle size distribution of the one-component non-magnetic toner; and b represents a particle size [μm] in a particle size segment having a largest particle count in the particle size distribution in every charge quantity segment.

3. The developing, method as set forth in claim 1, wherein the control step is performed to satisfy a relation that an amount of toner having a polarity opposite to the desired polarity of the one-component non-magnetic toner is less than 5%.

4. The developing method as set forth in claim 3, wherein the control step is performed to satisfy a relation that a toner particle count in a charge quantity segment having a largest particle count in the charge quantity distribution in every particle size segment is 10% or higher of total toner.

5. The developing method as set forth in claim 1, wherein at least one of kinds, resin composition and shape of the toner base particles of the one-component non-magnetic toner is determined in the control step.

6. The developing method as set forth in claim 1, wherein at least one of kinds and quantities of the extraneous additives added to the one-component non-magnetic toner is determined in the control step.

7. The developing method as set forth in claim 1, wherein a surface material of the developer carrier is determined in the control step.

8. The developing method as set forth in claim 1, wherein a regulating condition of the regulating member is determined in the control step.

9. The developing method as set forth in claim 1, wherein the transporting quantity of the one-component non-magnetic toner is determined in the control step.

10. An image forming method, comprising the steps of:

carrying a one-component non-magnetic toner on a developer carrier;

pressing the one-component non-magnetic toner by a regulating member so as to regulate a thickness thereof and to charge the one-component non-magnetic toner;

forming an electrostatic latent image on an image carrier;

providing the one-component non-magnetic toner to the electrostatic latent image so as to convert the electrostatic latent image into a visible toner image;

controlling the one-component non-magnetic toner on the developer carrier so that the one-component non-magnetic toner pressed by the regulating member satisfies the following relationship:

$$B/A \leqq 1$$

where A represents a width [μm] of a particle size distribution of the one-component non-magnetic toner; and B represents a width [fC] of a charge quantity distribution of the one-component non-magnetic toner; and transferring the visible image so as to form an image.

11. The image forming method as set forth in claim 10, wherein the method uses an image forming apparatus having no cleaner mechanism that cleans waste toner remaining on the image carrier after the transferring step.

* * * * *